US009132439B2

(12) United States Patent
Morioka et al.

(10) Patent No.: US 9,132,439 B2
(45) Date of Patent: Sep. 15, 2015

(54) ELECTROSTATIC ATOMIZER AND AIR CONDITIONER

(75) Inventors: Reiji Morioka, Chiyoda-ku (JP); Takahiro Sakai, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 725 days.

(21) Appl. No.: 12/782,179

(22) Filed: May 18, 2010

(65) Prior Publication Data

US 2010/0313580 A1 Dec. 16, 2010

(30) Foreign Application Priority Data

Jun. 15, 2009 (JP) ..... 2009-142787

(51) Int. Cl.
*B05B 5/057* (2006.01)
*B05B 5/16* (2006.01)
*F24F 6/12* (2006.01)

(52) U.S. Cl.
CPC . *B05B 5/057* (2013.01); *B05B 5/16* (2013.01); *F24F 6/12* (2013.01)

(58) Field of Classification Search
CPC ..... B05B 5/025; B05B 5/0255
USPC ..... 62/3.4, 91, 274, 281, 316; 239/3, 690, 239/704, 706, 707
See application file for complete search history.

(56) References Cited

U.S. PATENT DOCUMENTS 5,455,128 A 10/1995 Tanaka
7,473,298 B2 1/2009 Suda et al.
7,567,420 B2 7/2009 Kobayashi et al.
2004/0069459 A1 4/2004 Tonosaki et al.
2006/0201162 A1* 9/2006 Hsieh ..... 62/3.4
2007/0252083 A1* 11/2007 Arscott et al. ..... 250/288

(Continued)

FOREIGN PATENT DOCUMENTS

CN 1158774 A 9/1997
CN 101235977 A 8/2008

(Continued)

OTHER PUBLICATIONS

Author: P. Khayargoli et al. Title: The impact of microstructure on the permeability of metal foams. Date: 2004. Publisher: CSME.*

(Continued)

*Primary Examiner* — Cheryl J Tyler
*Assistant Examiner* — Antonio R Febles
(74) *Attorney, Agent, or Firm* — Buchanan Ingersoll & Rooney PC

(57) ABSTRACT

An atomizing electrode includes: a trunk unit made to be tabular-shaped and almost rectangular-shaped for receiving water dropped from water supply means in a direction of gravitational force and delivering the water; and a top end atomizing unit which is a plate-shaped projection formed so as to be projected from a side surface of the trunk unit and formed unitedly with the trunk unit. The trunk unit of the atomizing electrode extends a long-side direction in a horizontal direction, is provided below the cooling unit with a space of a predetermined distance so as not to contact the cooling unit, and is arranged so that when the cooling unit is projected in the direction of gravitational force, a width of the cooling unit in a horizontal direction should be included in a width of a long-side direction of a top surface of the trunk unit exposed to the cooling unit.

7 Claims, 17 Drawing Sheets

(56) References Cited

U.S. PATENT DOCUMENTS

| | | | | |
|---|---|---|---|---|
| 2009/0136261 | A1* | 5/2009 | Hayashi et al. | 399/171 |
| 2010/0000240 | A1* | 1/2010 | Nakada et al. | 62/91 |
| 2012/0017630 | A1* | 1/2012 | Okabe et al. | 62/407 |

FOREIGN PATENT DOCUMENTS

| | | | | | |
|---|---|---|---|---|---|
| EP | 0 764 489 | A1 | | 3/1997 | |
| EP | 0 765 704 | A2 | | 4/1997 | |
| JP | 58072824 | A | * | 4/1983 | F24F 1/00 |
| JP | 03275112 | A | * | 12/1991 | B01D 53/26 |
| JP | 06-111849 | A | | 4/1994 | |
| JP | 07-167455 | | | 7/1995 | |
| JP | 11-137946 | A | | 5/1999 | |
| JP | 2004-088048 | A | | 3/2004 | |
| JP | 2004-255517 | A | | 9/2004 | |
| JP | 2004-351276 | A | | 12/2004 | |
| JP | 2005-192822 | A | | 7/2005 | |
| JP | 2005-296753 | A | | 10/2005 | |
| JP | 2006-068711 | | | 3/2006 | |
| JP | 2006-068711 | A | | 3/2006 | |
| JP | 2006068711 | A | * | 3/2006 | |
| JP | 2006-090632 | | | 4/2006 | |
| JP | 2006090632 | A | * | 4/2006 | |
| JP | 2006-234245 | A | | 9/2006 | |
| JP | 2007-101140 | A | | 4/2007 | |
| JP | 2007-181835 | A | | 7/2007 | |
| JP | 2007-181836 | A | | 7/2007 | |
| JP | 2007-181837 | A | | 7/2007 | |
| JP | 2007-273100 | A | | 10/2007 | |
| JP | 2007-275800 | | | 10/2007 | |
| JP | 2007-278569 | A | | 10/2007 | |
| JP | 2007263551 | A | * | 10/2007 | |
| JP | 2008-142661 | | | 6/2008 | |
| JP | 2008-185289 | | | 8/2008 | |
| JP | 2008-190813 | | | 8/2008 | |
| JP | 2008185289 | A | * | 8/2008 | |
| JP | 2008-212887 | A | | 9/2008 | |
| JP | 2009-045554 | | | 3/2009 | |
| JP | 2009-090192 | A | | 4/2009 | |
| JP | 2009-090280 | A | | 4/2009 | |
| JP | 2009-090281 | A | | 4/2009 | |
| JP | 2009-090282 | | | 4/2009 | |
| JP | 2009-090282 | A | | 4/2009 | |
| JP | 2009090192 | A | * | 4/2009 | |
| JP | 2009090282 | A | * | 4/2009 | |
| JP | 2009-133603 | | | 6/2009 | |
| JP | 2011252688 | A | * | 12/2011 | |
| TW | 200922694 | A | | 6/2009 | |
| WO | WO 2007145280 | A1 | * | 12/2007 | F24F 13/22 |
| WO | 2009/044939 | A1 | | 4/2009 | |
| WO | WO 2009/044939 | | | 4/2009 | |
| WO | WO 2009044939 | A1 | * | 4/2009 | B05B 5/025 |

OTHER PUBLICATIONS

Office Action dated Aug. 24, 2012, issued by the European Patent Office in corresponding European Application No. 10004941.0. (5 pages).

Office Action dated May 31, 2011, issued in the corresponding Japanese Patent Application No. 2011-034040, and an English Translation thereof.

Office Action dated Apr. 5, 2012, issued in corresponding Chinese Patent Application No. 201010126093.4, and a partial English Translation thereof. (11 pages).

European Search Report dated Sep. 30, 2010, issued in the corresponding European Application No. 10004941.0-2425.

Official Action issued by Chinese Patent Office on Apr. 16, 2013 in Chinese Application No. 2010101260934, and partial English language translation of Official Action (12 pgs).

Office Action from Chinese Patent Office dated Dec. 12, 2012, issued in corresponding Chinese Patent Appln. No. 201010126093.4, with English translation (8 pages).

Official Action issued by State Intellectual Property Office of People's Republic of China on Sep. 23, 2013 in Chinese Application No. 2010101260934, and English language translation of Official Action (16 Pgs).

Official Action issued by the Japanese Patent Office on Oct. 1, 2013 in corresponding Japanese Patent Application No. 2009-142778, and a partial English Translation of the Official Action. (9 pages).

Official Action issued by Japanese Patent Office on May 13, 2014 in Japanese Application No. 2009-142778, and English language translation of Official Action (5 pgs).

* cited by examiner

DEFORMED EXAMPLE 1

DEFORMED EXAMPLE 2

DEFORMED EXAMPLE 3

DEFORMED EXAMPLE 4

DEFORMED EXAMPLE 5

COMPARISON OF OZONE PRODUCTION
ACCORDING TO DIFFERENT RAW MATERIALS

ELECTROSTATIC ATOMIZER AND AIR CONDITIONER

BACKGROUND OF THE INVENTION

1. Field of the Invention

The present invention relates to an electrostatic atomizer for generating mist of nanometer size (particulate water) by the electrostatic atomization phenomena, and an air conditioner mounting the electrostatic atomizer.

2. Discussion of the Background

Conventionally, an electrostatic atomizer has been proposed, in which ceramic porous body delivering water is made to stand up in a water reserving unit, water in the water reserving unit is sucked up to the upper end by capillary action, and by applying high voltage to the ceramic porous body, at the upper end which is pin-shaped, sucked water is crushed and released in the air. It has been necessary for the user to supply water to the water reserving unit (for example, refer to Patent Document 1).

Further, another electrostatic atomizer has been proposed, in which a metal bar itself is cooled, water in the air is condensed directly on the surface of the metal bar, and by applying high voltage to the metal bar, water which is condensed and attached to the top end of the metal bar is crushed and released in the air; it is unnecessary for the user to supply water (for example, refer to Patent Document 2).

Further, another electrostatic atomizer has been proposed as well as Patent Document 2, in which a cooling surface (a heat exchanging surface) is included as the water supply means, a water keeping unit is provided for keeping condensed water which is condensed and generated on the cooling surface, the ceramic porous body is contacted with the water keeping unit, and the water in the water keeping unit is delivered to the ceramic porous body by capillary action up to the top end and atomized (for example, refer to Patent Documents 3 to 5).

The mist generated by crushing the water with high voltage has the particle diameter being around 3 to 50 nm (nanometer=$10^{-9}$ meter) and is smaller than the size of corneocyte of the human, so that it gives moisturizing action to the skin by permeating the corneocyte of the human, and further, it also has an effect to make the skin surface hydrophilic. Further, since the mist is charged due to the high voltage, it tends to approach to a person who generates a potential difference.

LIST OF REFERENCES

[Patent Document 1] JP 2004-351276A
[Patent Document 2] JP 2006-68711A
[Patent Document 3] JP 2007-181835A
[Patent Document 4] JP 2007-181836A
[Patent Document 5] JP 2007-181837A As a conventional electrostatic atomizer, as described in Patent Document 1, the water reserved in the water reserving unit is sucked up to the upper end by the ceramic porous body; however, the internal porosity of the ceramic is low, further, the pore diameter is small, that is, although it is the porous body, the ceramic is material the inside of which is relatively dense. Accordingly, there is a problem that it takes time to deliver the water up to the upper end for atomizing, and it takes long from starting the operation of the electrostatic atomizer before the mist generation.

Further, in the electrostatic atomizer like the one disclosed in Patent Document 2 for which the water supply by the user is unnecessary, since the metal bar does not have a slit hole like the ceramic porous body, it has no water absorption function nor delivery function. Accordingly, there is a problem that only small amount of the atomization (generating mist amount) can be obtained using only attached amount of water condensed on the surface of the top end of the metal bar, and further the mist generation is not stable.

Further, in the electrostatic atomizer disclosed in other Patent Documents 3 to 5, even if the water keeping member for keeping the condensation water obtained at the cooling surface and the ceramic porous body which is a water deliverer are contacted, receiving/sending water is not carried out smoothly between the two materials, the water (the condensation water) becomes hard to move from the water keeping unit to the water deliverer. There is a problem that the delivering amount of the water deliverer becomes small and only small atomizing amount (generating mist amount) can be obtained, and further that the mist generation is not stable.

The present invention is done in order to solve the above problems, and aims to provide an electrostatic atomizer which can guide rapidly and steadily water supplied from the water supply means to the top end atomizing unit of the atomizing electrode and can obtain stably a large amount of electrostatic mist, and an air conditioner which can stably release plenty of the electrostatic mist to the indoors using the electrostatic atomizer.

SUMMARY OF THE INVENTION

According to the present invention, an electrostatic atomizer includes: water supply means having a Peltier unit and a cooling unit contacting to a cooling surface of the Peltier unit, for dropping water condensed at the cooling unit from the cooling unit in a direction of gravitational force; and an atomizing electrode formed by a porous body for receiving the water dropped from the water supply means and for atomizing the water at a top end atomizing unit by being applied with high voltage. The atomizing electrode includes: a trunk unit made to be tabular-shaped and almost rectangular-shaped for receiving the water dropped from the cooling unit in the direction of gravitational force and delivering the water to the top end atomizing unit; and the top end atomizing unit which is a plate-shaped projection formed so as to be projected from a side surface of the trunk unit and formed unitedly with the trunk unit. The trunk unit extends a long-side direction in a horizontal direction, is provided below the cooling unit with a space of a predetermined distance L1 so as not to contact the cooling unit. The trunk unit is arranged so that when the cooling unit is projected in the direction of gravitational force, a width of the cooling unit in a horizontal direction should be included in a width of a long-side direction of a top surface of the trunk unit exposed to the cooling unit.

BRIEF DESCRIPTION OF THE DRAWINGS

A complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Embodiment 1

Figure 1:
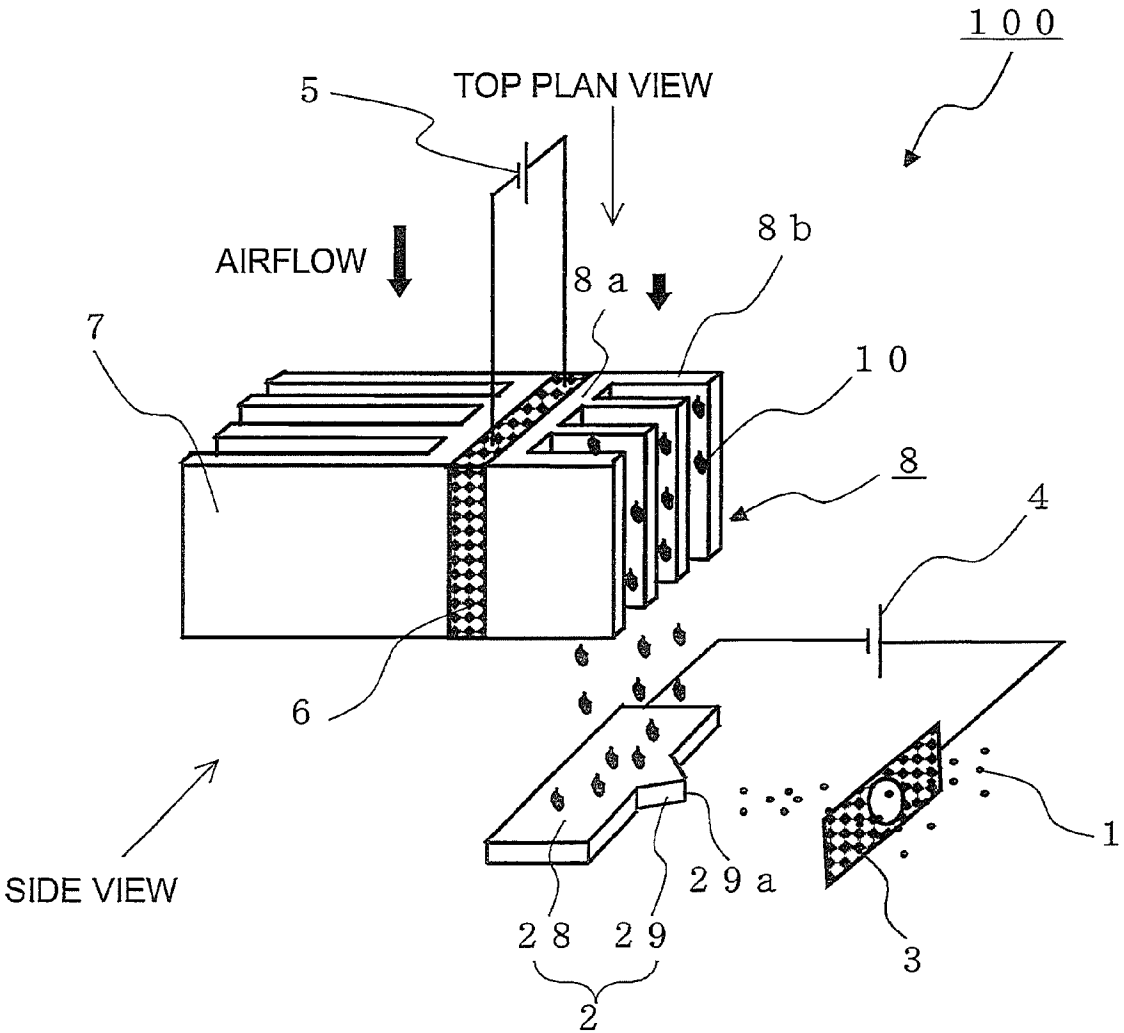
FIG. 1 shows the first embodiment, and is a schematic configuration diagram of an electrostatic atomizer 100.

FIGS. 1 to 17 show the first embodiment; first, with reference to FIGS. 1 to 4, a configuration of an electrostatic atomizer 100 will be explained. The electrostatic atomizer 100 of the present embodiment includes an atomizing electrode 2 and a counter electrode 3 to generate an electrostatic mist 1 of nanometer ($10^{-9}$ m) size as shown in FIG. 1.

The atomizing electrode 2 includes a trunk unit 28 and a top end atomizing unit 29 which are both plate-shaped, and water supplied to the trunk unit 28 is moved (delivered) to the top end atomizing unit 29. The top end (the projected end) of the top end atomizing unit 29 is arranged so as to be directed to the counter electrode 3. For the atomizing electrode 2, porous body is used as material; however, here, in particular, foam metal which is metal porous body having three-dimensional net structure is used. These will be explained later in detail.

Between the atomizing electrode 2 and the counter electrode 3, high voltage of around 4 to 6 kV supplied from a high-voltage supply unit 4 is applied. Here, the counter electrode 3 works as a ground electrode, which is potential 0 V, and negative DC voltage of −4 to −6 V is applied to the atomizing electrode 2.

The shape of the trunk unit 28 of the atomizing electrode 2 is almost rectangular-shaped, and above the trunk unit 28, separated with a space of a predetermined distance L1 (refer to FIG. 2), plural cooling fins 8*b* of the cooling unit 8, which is contacted to the cooling surface of the Peltier unit 6 being a part of the water supply means, are positioned so that the fins are parallelly aligned in almost horizontal direction. The trunk unit 28 is formed by extending the long-side direction width (the width of the longitudinal direction) in the parallel-aligning direction of the cooling fins 8*b*. Namely, the long-side direction (the longitudinal direction) of the trunk unit 28 being almost rectangular-shaped almost agrees with the parallel-aligning direction of the cooling fins 8*b* of the cooling unit 8.

The atomizing electrode 2 is positioned below the cooling fins 8*b* with the space of the predetermined distance L1 and includes the trunk unit 28 being tabular-shaped which extends the width of the longitudinal direction (the long-side direction) in the parallel-aligning direction of the cooling fins 8*b*. Then, the short-side direction of the trunk unit 28 almost agrees with the projected direction of the cooling fins 8*b*. The trunk unit 28 has an elongated shape, in which the width of the long-side direction is equal to or greater than three times of the width of the short-side direction. Then, the plate thickness of the plate-shaped atomizing electrode 2 is smaller than the short-side direction width of the trunk unit 28.

Here, the shape of the trunk unit 28 has been explained as almost rectangular-shaped, the shape is not limited to a complete rectangle which forms a right angle with the long side and the short side but can be a parallelogram or a trapezoid in which the angle formed by the short side with respect to the long side is an acute angle or an obtuse angle, namely, the two long sides are mutually in parallel, but the short side is not connected orthogonally to the long side. The trunk unit 28 being almost rectangular-shaped includes not only a rectangle, but also a parallelogram or a trapezoid like the above.

Further, the atomizing electrode 2 is provided with the top end atomizing unit 29 in the middle of the side surface of the long-side direction (the longitudinal direction) of the trunk unit 28 so as to be projected from the side surface as shown in FIG. 1. The top end atomizing unit 29 is a plate-shaped projection having the same thickness and being continuous to the trunk unit 28, the shape of which is triangular-shaped in a top plan view. As for the top end atomizing unit 29 being triangular-shaped, the surface of the bottom side is connected to the side surface in the long-side direction of the trunk unit 28, a top end 29*a* (the projected end) being a peak is directed to the counter electrode 3. This top end 29*a* becomes a part discharging with the counter electrode 3. Here, FIGS. 1 to 4 show a case where the projection which is the top end atomizing unit 29 is one; however, the projection can be plural.

Figure 5:
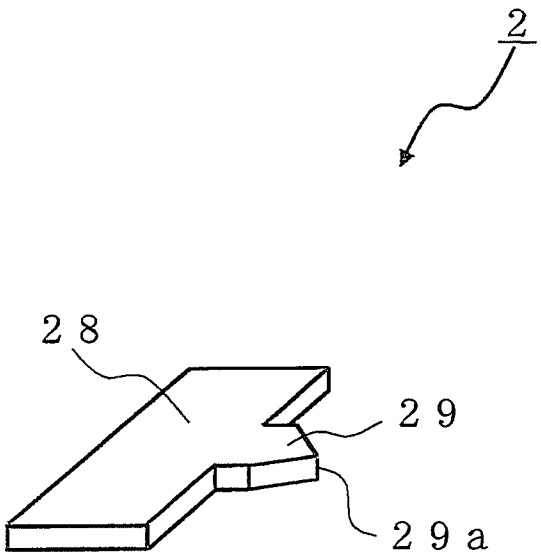
FIG. 5 shows the first embodiment, and is a schematic configuration diagram of a deformed example of the atomizing electrode 2.

Further, the shape of projection which is the top end atomizing unit 29 can be, what is called, a home-plate shape having a rectangular-shaped part which is connected to the trunk unit 28 and a triangular-shaped part of which the surface of the bottom side is connected to the rectangular-shaped part as shown in FIG. 5, and the top end 29*a* (the projected end) being a peak of the triangular-shaped part can be directed to the counter electrode 3.

The top end atomizing unit 29 of the atomizing electrode 2, whether it is triangular-shaped as shown in FIG. 1 or home-plate-shaped shown in FIG. 5 in top plan view, as well as the trunk unit 28, is plate-shaped having a thickness and formed in a united manner with the trunk unit 28, the top end 29*a* directed to the counter electrode 3 also has a thickness, and the top end 29*a* is pointed linearly. Since the top end 29*a* is pointed linearly, two angular parts are formed at the upper and lower ends.

The top end atomizing unit 29 is formed continuously to the trunk unit 28 in the middle of the side surface extending to the parallel-aligning direction of the cooling fins 8*b* which is the long-side direction (the longitudinal direction) of the trunk unit 28 being tabular-shaped, and is a plate-shaped projection projected towards the counter electrode 3 from the side surface in the long-side direction of the trunk unit 28; the shape is such that the projection width decreases as approaching to the top end 29*a* and that the top end 29*a* is formed to be a linearly fine state or a very thin state being close to the linearly fine state.

The counter electrode 3 is formed to be plate-shaped using conductive metal or resin, and has an opening in its almost center. The counter electrode 3 is positioned separately with a certain distance from the top end 29*a* of the top end atomizing unit 29 so that the opening should face the top end atomizing unit 29 of the atomizing electrode 2.

Next, the water supply means positioned above the atomizing electrode 2 will be explained. The electrostatic atomizer 100 shown in FIG. 1 has the water supply means structured by a Peltier unit 6, a heat radiating part 7 contacting to a heat radiating surface of the Peltier unit 6, and a cooling unit 8 contacting to a cooling surface positioned at the opposite side of the heat radiating surface. Then, water generated by the water supply means is supplied by dropping with the gravitational force to a top surface of the trunk unit 28 of the atomizing electrode 2.

Each of the heat radiating part 7 and the cooling unit 8 has a base board contacting to the Peltier unit 6 and plural fins standing almost vertically on the surface at the non-Peltier unit side of the base board. The plural fins of the heat radiating part 7 and the cooling unit 8 are aligned in a direction being almost orthogonal to the passing airflow so that each fin should be in almost parallel with the passing airflow. Here, since the airflow is in almost direction of gravitational force, respective fins of the heat radiating part 7 and the cooling unit 8 are aligned in almost horizontal direction which is a direction being almost orthogonal to the direction of gravitational force. Here, in order to cool efficiently the cooling unit 8, the fins of the heat radiating part 7 are formed to have a surface area being larger than the fins of the cooling unit 8.

Figure 3:
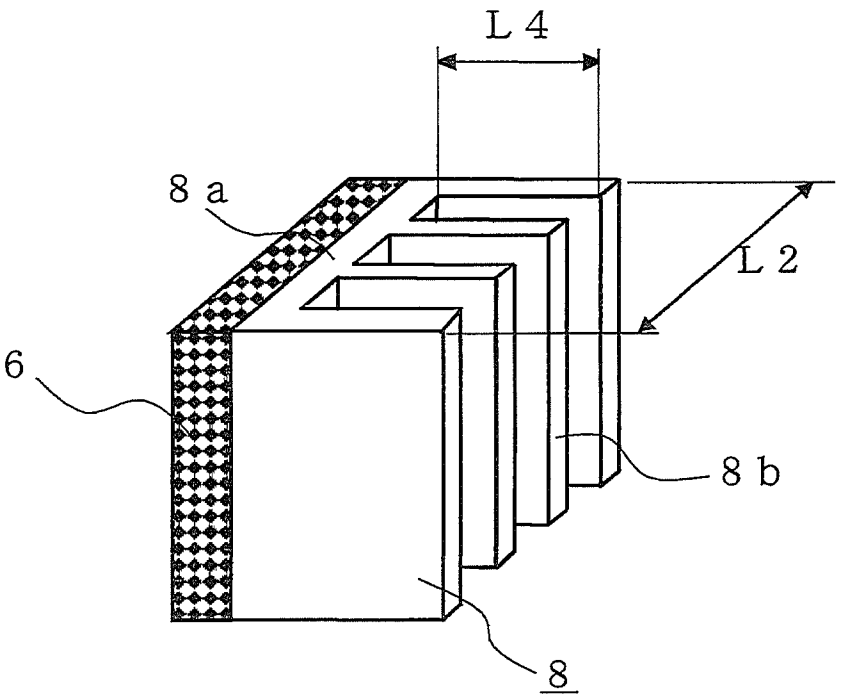
FIG. 3 shows the first embodiment, and is a schematic configuration diagram of a cooling unit 8 of a water supply means.

FIG. 3 is a schematic configuration diagram of the cooling unit 8; the cooling unit 8 includes the base board 8*a* contacting to the Peltier unit 6 and the plural cooling fins 8*b* standing almost vertically on the surface of the base board 8*a* at non-Peltier unit side. The plural cooling fins 8*b* are aligned in the almost horizontal direction as discussed above. L2 shown in FIG. 3 is the width of the cooling fins 8*b* in the parallel-aligning direction, and is a distance from the outer side surface of the cooling fin 8*b* located at one end of the parallel-aligning direction to the outer side surface of another cooling fin 8*b* located at the other end. Including the cooling fins 8*b* at both ends, the plural cooling fins 8*b* located within a range of the width L2 are all exposed in the air.

Further, L4 shown in FIG. 3 is a projected height of the cooling fin 8*b* and is a distance to the projected end from the base end on the base board 8*a*, namely, a distance to the projected end of the cooling fin 8*b* from the surface at the non-Peltier unit side of the base board 8*a*. Here, the lower end surfaces of the plural cooling fins 8*b* are totally exposed so as to face the top surface of the trunk unit 28 of the atomizing electrode 2 with the predetermined distance L1.

If a part adjacent to the base end of the lower end surface of the above cooling fins 8*b* is partially covered by a holding frame, etc. for fixing the cooling unit 8, the distance L4 should be changed to another value obtained by subtracting the covered distance. In such a case, the distance L4 becomes the exposed length of the lower end surface of the cooling fins 8*b* in the projected direction.

Plural semiconductor PN junctions are provided inside of the Peltier unit 6; when DC voltage of around 1 to 5 V is applied to the Peltier unit 6 from the low voltage supplying unit 5, the current flows in one direction. The heat amount of the heat discharging surface is increased by the Peltier effect, and the heat is absorbed at the cooling surface. By this operation, the heat radiating part 7 is heated, and the cooling unit 8 is cooled.

When the temperature of the cooling unit 8 is cooled up to equal to or less than the dew point of the passing air by the Peltier unit 6, condensation water 10 which is condensed water in the air is generated on the surface of the cooling fins 8*b* of the cooling unit 8. The generated condensation water 10 falls along the surface of the cooling fins 8*b* towards the lower ends of the cooling fins 8*b* by the gravitational force, and after it falls up to the lower ends, the condensation water is dropped downwardly from the cooling fins 8*b* by the gravitational force. Since the passing air flows in almost same direction of the gravitational force, the condensation water 10 is easily generated on the surface of the upper side of the cooling fins 8*b*. As the passing air flows downwardly, the water in the air decreases, and thus the condensation becomes difficult. The condensation hardly occurs on the lower end surfaces of the cooling fins 8*b*.

The heat radiating part 7 and the cooling unit 8 are formed by aluminum as material. A general contact angle with water of aluminum fin is 50 to 70 degrees. Here, at least water repellent treatment for increasing the contact angle up to equal to or greater than 90 degrees or hydrophilic treatment for decreasing the contact angle up to equal to or less than 30 degrees is carried out on the cooling fins 8*b*. By this operation, the generated condensation water 10 is made to easily move on the surfaces of the cooling fins 8*b* in the direction of gravitational force, and the generated condensation water 10 is made to be rapidly dropped from the cooling fins 8*b*.

Here, the contact angle of water means an angle made by the waterdrop surface and the solid surface when the waterdrop is put on the solid surface and the waterdrop is balanced, that is, an angle made by a tangential line formed by the waterdrop and the surface of the cooling fin 8*b* at a contacting point where the waterdrop contacts the surface of the cooling fin 8*b*.

Figure 2:
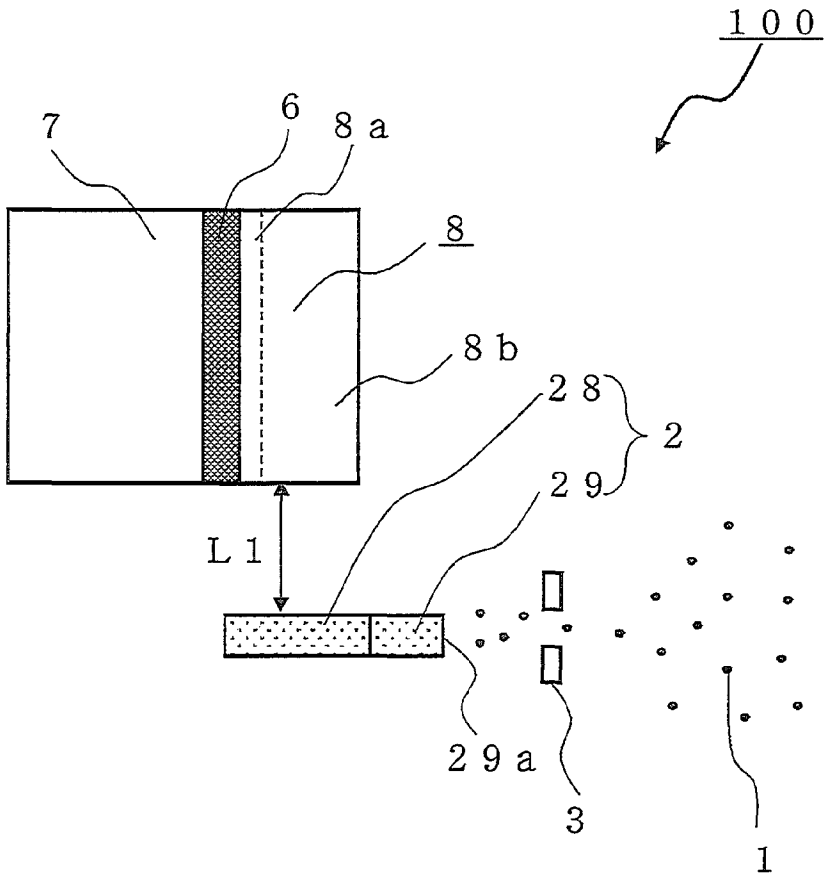
FIG. 2 shows the first embodiment, and is a side view of the electrostatic atomizer 100.

Here, below the cooling unit 8 in the direction of gravitational force, the atomizing electrode 2 is arranged through the space of predetermined length of L1 from the lower end of the cooling fin 8*b* as shown in FIG. 2. The cooling unit 8 and the atomizing electrode 2 do not have parts which directly contact with each other. The condensation water 10 dropped from the lower end of the cooling fin 8*b* falls to the top surface of the trunk unit 28 of the atomizing electrode 2. Namely, the trunk unit 28 being almost rectangular-shaped of the atomizing electrode 2 extends the long-side direction in parallel-aligning direction of the cooling fins 8*b* and is arranged directly below (just below) the cooling fins 8*b* with the space of the distance L1.

The condensation water 10 fallen by the gravitational force on the top surface of the trunk unit 28 is absorbed to the inside of the atomizing electrode 2 which is the metal porous body and is moved by the surface diffusion in gaps, the inside of which are mutually connected three-dimensionally with each other. The condensation water 10 is delivered to the top end atomizing unit 29 from the trunk unit 28 in the inside of the atomizing electrode 2 by surface diffusion phenomena like this.

When the water (the condensation water 10) is delivered up to adjacent area of the top end 29*a* of the top end atomizing unit 29 of the atomizing electrode 2, the water adjacent to the top end 29*a* is applied with the high voltage, and the water is charged with the same potential as the atomizing electrode 2, namely, the negative high voltage, since the negative high voltage of −4 to −6 kV is applied to the atomizing electrode 2 with respect to the counter electrode 3 which is the ground electrode. Therefore, the charged water is pulled to the outside of the atomizing electrode 2 locally from the top end 29*a* and forms an embossment of a so-called Taylor cone by the action of coulomb force in the electrostatic field. At this time, since the water that forms Taylor cone is attached to the atomizing electrode 2, the water is continuously charged. Then, when the acted coulomb force exceeds the surface tension of water, the water that forms Taylor cone is popped out, fission like bursting (this fission is called Rayleigh fission) is repeated, and the charged electrostatic mist 1 of nanometer size is generated. The electrostatic mist 1 moves towards the counter electrode 3 and is released to the outside from the opening of the counter electrode 3.

Here, in order to pop out the charged water from the top end 29*a* of the top end atomizing unit 29, it is necessary to converge electric fields. As for the atomizing electrode 2, since the top end atomizing unit 29 is formed to be plate-shaped and the top end 29*a* which is the discharging part is pointed linearly, it is possible to converge the electric fields at least at two angular parts of the upper and lower ends of the top end 29*a*.

Therefore, on the contrary to the case where adjacent area of the top end is formed to be subulate-shaped (a pyramid or a cone), the top end which is the discharging part is sharpened to be pin-shaped, and Taylor cone of water is formed at only the pin-shaped top end, in case of the sharpened linearly top end 29*a*, Taylor cone of water can be formed at least at two angular parts of the upper and lower ends. Compared with the case where the discharging part is formed to be the pin-shaped top end, it is possible to efficiently generate a large amount of the electrostatic mist 1. Here, since the top end 29*a* is sharpened linearly, electric field is converged, though it does not as much as the angular parts of the upper and lower ends, Taylor cone of water is sometimes formed at somewhere between the upper and lower angular parts, and it is possible to efficiently generate a large amount of the electrostatic mist 1.

In order to facilitate convergence of the electric fields, in the top end atomizing unit 29, it is preferable to form an angle α (shown in FIG. 4) of the peak of a triangular shape in a top plan view towards the counter electrode 3 should be an acute angle, preferably equal to or less than 60 degrees. An angle of a peak which is most distant from the trunk unit 28 of the top end atomizing unit 29, which is a triangular shape in top plan view, is the angle α. Further, in the production process or the delivery process of the atomizing electrode 2, if linearly projected, the top end atomizing unit 29 may be broken. In order to avoid the breakage, it is preferable to make the projected height L6 (shown in FIG. 4) of the top end atomizing unit 29 equal to or less than the short-side direction width of the trunk unit 28, and it is better to make the angle α of the peak equal to or greater than 15 degrees.

The electrostatic mist 1 generated like this is called as simply mist or particulate water; since it is charged, the electrostatic mist 1 is sometimes called as charged mist or charged particulate water. Further, since the size is nanometer size, the electrostatic mist 1 is sometimes also called as nano mist. In either way, the electrostatic mist 1 is charged mist of nanometer size (particulate water) generated from water applied with high voltage and miniaturized by Rayleigh fission; here, the mist generated like this is called as the electrostatic mist 1. Further, to generate the electrostatic mist 1 like this is called as electrostatic atomization, and the atomization means to atomize water. Then, atomizing amount means generation amount (production amount) of the electrostatic mist 1.

Figure 4:
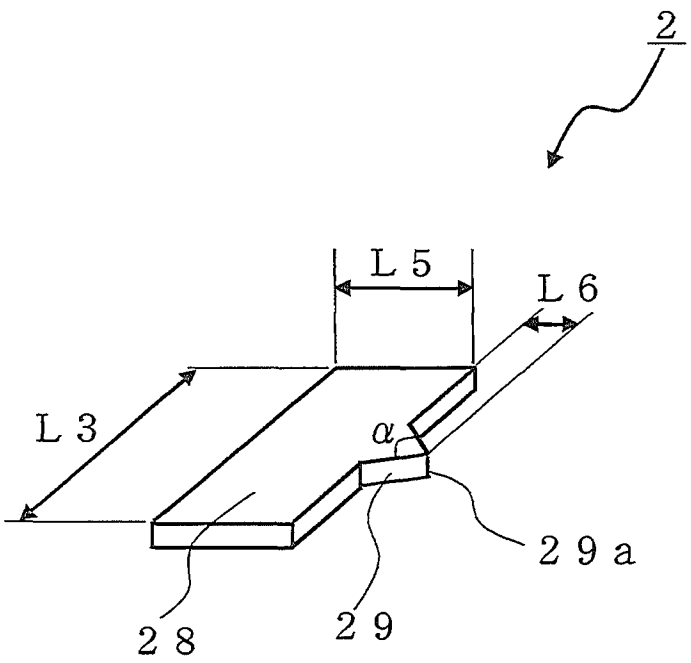
FIG. 4 shows the first embodiment, and is a schematic configuration diagram of an atomizing electrode 2.

FIG. 4 is a schematic configuration diagram of the atomizing electrode 2. L3 shown in this figure is a width of the long-side direction (the longitudinal direction) of the top surface of the trunk unit 28 exposed facing the cooling fins 8*b* located above, and a width in the same direction as the parallel-aligning direction of the cooling fins 8*b*.

For example, when a connecting terminal with the high-voltage supply unit 4 is attached to one end of the long-side direction of the trunk unit 28, and if the top surface of one end part of the trunk unit 28 is not exposed to the cooling fins 8*b* by the connecting terminal or by a separate cover which is arranged to protect the connecting terminal, the one end part is not included in the above the width L3. The width L3 does not simply mean the length of the long-side direction of the trunk unit 28, but is the width of the long-side direction of the top surface of the trunk unit 28 exposed to the cooling fins 8*b* located above, and the part which is not exposed to the upper side is not included in the width L3.

Further, L5 shown in FIG. 5 is a width of the direction being orthogonal to L3, a width of the short-side direction of the top surface of the trunk unit 28 exposed to the cooling fins 8*b*, and a width in the same direction as the projected direction of the cooling fins 8*b*.

Here, the atomizing electrode 2 is formed so that the width L3 of the trunk unit 28 should be equal to or greater than the width L2 of the above-discussed parallel-aligning direction of the cooling fins 8*b*. Namely, the width L3≥the width L2. Further, the atomizing electrode 2 is formed so that the width L5 of the trunk unit 28 should be equal to or greater than the above-discussed projected height L4 of the cooling fins 8*b*. Namely, the width L5≥L4.

Further, the trunk unit 28 of the atomizing electrode 2 is arranged with respect to the cooling fins 8*b* so that when the cooling fins 8*b* are totally projected over the trunk unit 28 of the atomizing electrode 2 in the direction of gravitational force, the parallel-aligning direction width L2 should almost agree with the long-side direction width L3 of the trunk unit 28, or the width L2 should be included in the width L3, and further, the height L4 should almost agree with the short-side direction width L5 of the trunk unit 28, or the height L4 should be included in the width L5.

The plural cooling fins 8*b* located above and the trunk unit 28 of the atomizing electrode 2 which is located below the plural cooling fins 8*b* and positioned with the gap L1 so as not to contact the cooling unit 8 have such a positional relation. Therefore, it is possible to receive laconically and steadily a large amount of the condensation water 10 dropped widely from the lower ends of the plural cooling fins 8*b* in the parallel-aligning direction by the gravitational force using the top surface of the trunk unit 28 acting as the water receiving surface and deliver the condensation water 10 to the top end atomizing unit 29, and thus a large amount of the electrostatic mist 1 can be generated stably.

Further, as for the projected direction of the cooling fins 8*b*, if the condensation water 10 is dropped from any position in the projected direction having a range of the height L4 of the lower ends of the cooling fins 8*b*, it is possible to receive laconically and steadily the condensation water 10 by the top surface of the trunk unit 28 acting as the water receiving surface, and thus a large amount of the electrostatic mist 1 can be generated stably.

In particular, in order to obtain a large amount of the condensation water 10 at the cooling unit 8, the cooling fins 8*b* are aligned in parallel in the horizontal direction which is almost orthogonal to the airflow, the trunk unit 28 of the atomizing electrode 2 is made tabular-shaped and is formed so as to extend the width of the long-side direction in the parallel-aligning direction. Consequently, the condensation water 10 which is efficiently condensed with a large amount by the cooling fins 8*b* can be received by the top surface of the trunk unit 28 laconically and steadily, and thus the generation of the electrostatic mist 1 is stably continued.

Here, the cooling unit 8 of the water supply means does not always need to include the cooling fins 8*b*, but the cooling unit 8 can be configured so that only the base board 8*a* being tabular-shaped should contact the cooling surface of the Peltier unit 6, though the amount of generated condensation water 10 is reduced compared with a case having the cooling fins 8*b*. In this case, the base board 8*a* acts as the cooling board, the condensation water 10 is generated on the surface of the opposite side of the surface contacting the Peltier unit 6 (when the cooling fins 8*b* are provided, the surface from which the plural cooling fins 8*b* are projected), the condensation water 10 falls along the surface by the gravitational force towards the lower end, and after it falls up to the lower end, the condensation water 10 is dropped downwardly from the base board 8*a* by the gravitational force.

If the cooling unit 8 is configured not to include the cooling fins 8*b* but have only the base board 8*a* being tabular-shaped acting as the cooling board as discussed above, the width L3 of the trunk unit 28 of the atomizing electrode 2 can be formed so as to be equal to or greater than the width (the length) of the base board 8*a* in the horizontal direction. Namely, the width L3≥the width of the base board 8*a* in the horizontal direction. Then, the trunk unit 28 of the atomizing electrode 2 is arranged with respect to the cooling unit 8 so that the width of the base board 8*a* in the horizontal direction should almost agree with the long-side direction width L3 of the trunk unit 28, or should be included in the width L3 when the base board 8*a* is projected over the trunk unit 28 of the atomizing electrode 2 in the direction of gravitational force. Needless to say, the trunk unit 28 is positioned with the gap of the distance L1 below the base board 8*a*, and the cooling unit 8 and the atomizing electrode 2 are not contacted.

The positional relation is made like the above, and thereby it is possible to receive laconically and steadily the condensation water 10 dropped widely in the horizontal direction from the lower end of the base board 8*a* which is the cooling board by the gravitational force using the top surface of the trunk unit 28 acting as the water receiving surface and deliver the water to the top end atomizing unit 29; and thus a large amount of the electrostatic mist 1 can be generated stably.

Namely, regardless of the existence of the cooling fins 8*b*, the width L3 of the trunk unit 28 of the atomizing electrode 2 is made equal to or greater than the horizontal direction width of the cooling unit 8, namely, the width L3 is set to be the width L3≥the horizontal direction width of the cooling unit 8, and further, when the cooling unit 8 is projected over the trunk unit 28 of the atomizing electrode 2 in the direction of gravitational force, the horizontal direction width of the cooling unit 8 is made to almost agree with the long-side direction width L3 of the trunk unit 28, or to be included in the width L3, and thereby it is possible to receive laconically and steadily the condensation water 10 dropped widely from the cooling unit 8 in the horizontal direction by the gravitational force by the top surface of the trunk unit 28 acting as the water receiving surface and deliver the water to the top end atomizing unit 29; and thus a large amount of the electrostatic mist 1 can be generated stably.

In the cooling unit 8 shown in FIG. 3, the cooling fins 8*b* are provided projectedly also from the left and right ends of the base board 8*a*, and the width L2 in the parallel-aligning direction corresponds to the horizontal direction width of the cooling unit 8. The base board 8*a* is generally formed to be rectangular-shaped and is arranged so that the longitudinal direction should be orthogonal to the direction of passing airflow. Since the generation of condensation water 10 in the cooling unit 8 mostly occurs in the upstream of the cooling unit 8 (of the passing airflow), such arrangement allows to have a large area of the base board 8*a* (the surface of the opposite side of the surface contacting to the Peltier unit 6) contacting the airflow which contains a large amount of water. Therefore, the condensation water 10 generated in the cooling unit 8 is to be dropped widely in the horizontal direction.

Further, since the top end atomizing unit 29 is formed in the middle of the long-side direction side surface of the trunk unit 28, the condensation water 10 received by the trunk unit 28 can be delivered rapidly to the top end atomizing unit 29 compared with the case where the top end atomizing unit 29 is provided in the short-side direction side surface. Therefore, together with the fact that the passage of the condensation water 10 to the atomizing electrode 2 is a direct drop to the trunk unit 28 by the gravitational force, it is possible to generate the electrostatic mist 1 in a short time from starting the operation of the electrostatic atomizer 100. Assuming that the same amount of the condensation water 10 is dropped from each cooling fin 8*b*, when there exists only one top end atomizing unit 29, it is the most preferable from the viewpoint of stability of delivering water that the top end atomizing unit 29 should be arranged in the long-side direction side surface of the trunk unit 28 and at a position corresponding to the center of the parallel-aligning direction width L2 of the cooling fins 8*b*.

Here, the atomizing electrode 2 is configured not to reserve the condensation water 10 supplied by dropping from the cooling unit 8 in its surroundings. The holding frame for fixing the atomizing electrode 2 is not made to be a container so as not to reserve water. For example, an opening which opens downwardly is provided at the surrounding part including the lower surface (the surface of the opposite side of the top surface facing the cooling unit 8) of the atomizing electrode 2, so that unnecessary water is discharged from the holding frame of the atomizing electrode 2 through the opening; and thus water is made not to be reserved around the atomizing electrode 2.

The following shows the reasons not to reserve water around the atomizing electrode 2.

(1) If water is reserved on the atomizing electrode 2, with the intervention of the water reserved on the atomizing electrode 2, the distance between the atomizing electrode 2 (in particular, the trunk unit 28) and the cooling unit 8 (in particular, the cooling fins 8*b*) is shortened, discharge phenomena might occur from the atomizing electrode 2 which is high potential to the cooling unit 8. When discharge phenomena occur between the atomizing electrode 2 and the cooling unit 8, discharge between the atomizing electrode 2 and the counter electrode 3 becomes unstable, which inhibits proper generation of the electrostatic mist 1. Further, it is not preferable from the viewpoint of the reliability.

(2) The atomizing electrode 2 is formed by the porous body. If water amount is large in the atomizing electrode 2, the coulomb force does not exceed the surface tension of water which forms Taylor cone, the water becomes hard to leave the top end 29*a* of the top end atomizing unit 29. Namely, the water would not be popped out of the top end 29*a*, which inhibits the generation of the electrostatic mist 1. More efficient generation of the electrostatic mist 1 can be obtained when the inside voids (the pores) of the atomizing electrode 2 are made not to be saturated with water.

(3) If the Peltier unit 6 is immersed in water, there occurs a problem in the reliability. The Peltier unit 6 is configured by connecting in series PN semiconductors, and it becomes impossible to use if either of the PN semiconductors breaks down by the intrusion of water.

From the above reasons, it is necessary that the configuration does not reserve water around the atomizing electrode 2.

Here, the counter electrode 3 is provided so as to keep the potential difference constant with the atomizing electrode 2; however, without providing the counter electrode 3, the electrostatic mist 1 can be generated by discharge in the air (discharge with floating potential in the air). Further, by using a member of which potential is around 0 V among the equipment mounting the electrostatic atomizer 100 (for example, if it is mounted on the indoor unit of the air conditioner, the indoor heat exchanger provided inside of the indoor unit) as a substitute of the counter electrode 3 to keep the potential difference with the atomizing electrode 2 and the electrostatic mist 1 can be generated.

In the electrostatic atomizer 100, airflow passes the heat radiating part 7 and the cooling unit 8 in the direction of gravitational force, namely, from the upstream to the downstream; however, in order to prevent the decrease of the heat absorption amount in the cooling unit 8 and to decrease efficiently the temperature of the cooling fin 8*b*, the passing air amount (the amount of the passing airflow) to the cooling unit 8 is made small compared with the heat radiating part 7. As its implementing means, the heat radiating part 7 makes the upstream side open and does not give the ventilation resistance to the airflow passing the heat radiating part 7; however, at the cooling unit 8 side, a fence or a rib, etc. is provided at the upstream side to restrict the opening of the inflow opening to decrease the passing air amount. Like this, the passing air amount is decreased, the flow speed of the airflow passing the cooling unit 8 is made small up to around 0.1 m/s which is slight breeze status, and thereby the outflow of the airflow with seizing the cooling heat can be avoided. As a result of this, the cooling fins 8*b* can be cooled efficiently.

Then, though the flow speed is very small, since airflow exists in the cooling unit 8, fresh air including water is flown alternatively, and the air around the cooling unit 8 does not become dry, and thus the condensation water 10 is stably generated on the surface of the cooling fins 8*b* which are efficiently cooled.

Since the atomizing electrode 2 is formed by the metal porous body, the atomizing electrode 2 has property to deliver the received water to the top end atomizing unit 29 by receiving the condensation water 10 dropped on anywhere of the top surface of the trunk unit 28.

Namely, the atomizing electrode 2 itself includes three functions: such as the water receiving unit, the water delivering means, and the atomizing unit (the generating part of the electrostatic mist 1). Therefore, it is possible to have an effect to collect water rapidly to the top end atomizing unit 29 and to carry out the electrostatic atomization efficiently, properly, and stably.

In this electrostatic atomizer 100, as shown in FIG. 2, the trunk unit 28 of the atomizing electrode 2 is provided below the cooling unit 8 contacting the cooling surface of the Peltier unit 6 in the direction of gravitational force with the gap of the predetermined distance L1 at a distant position from which the direct contact with the cooling unit 8 is impossible.

Here, the predetermined gap L1 needs to have a distance such that the atomizing electrode 2 and the cooling unit 8 should not be electrically connected. In order to prevent discharge from the trunk unit 28 which is high potential to the cooling unit 8, the top surface of the trunk unit 28 exposed to the cooling fins 8*b* is formed flatly without providing a projection such as the top end atomizing unit 29 to which electric fields are converged. Then, in order to avoid insulation breakdown of the space between the trunk unit 28 and the cooling unit 8, the distance L1 needs to be at least 3 mm.

Further, the condensation water 10 is made to be dropped from the cooling fins 8*b* to the trunk unit 28, so that the insulating distance between the cooling fins 8*b* and the trunk unit 28 is essentially shortened by the length of the waterdrop just before dropping from the lower ends of the cooling fins 8*b*; considering such amount, the distance L1 needs to be at least 5 mm, and it is better to provide the trunk unit 28 with the gap L1 of equal to or greater than 5 mm from the lower ends of the cooling fins 8*b*.

In addition to the above, considering creeping discharge, etc. to surrounding members respectively holding the atomizing electrode 2 and the cooling unit 8, it is better to appropriately set the gap L1 to satisfy the reliability for the discharge.

In this electrostatic atomizer 100, between the cooling unit 8 and the top surface of the trunk unit 28 exposed to the cooling unit 8, other than the space, without intervention of the water collecting member for collecting water dropping from the cooling unit 8, the guide member for guiding water dropping to the trunk unit 28, and further, the water keeping member for keeping temporarily water for dropping before it reaches the trunk unit 28, etc., the condensation water 10 is dropped directly to the top surface of the trunk unit 28 by the gravitational force. There is no element to prevent the movement of water from the cooling unit 8 to the trunk unit 28. By this operation, it is possible to supply the condensation water 10 generated in the cooling unit 8 rapidly and steadily to the atomizing electrode 2 in a short time.

Then, since the atomizing electrode 2 and the cooling unit 8 are not contacted, there is no fear of breakdown of the Peltier unit 6 which might occur when high voltage is applied to the Peltier unit 6. Like this, a position to which high voltage is applied is limited to the atomizing electrode 2.

Further, the metal porous body (a detail will be explained later) is used as material of the atomizing electrode 2, and thereby once water is supplied to a part of the trunk unit 28, the water proceeds through the inside voids by the surface diffusion and can be delivered rapidly to the top end atomizing unit 29; thus it is possible to reduce the time from starting the operation until the generation of the electrostatic mist 1.

Figure 6:
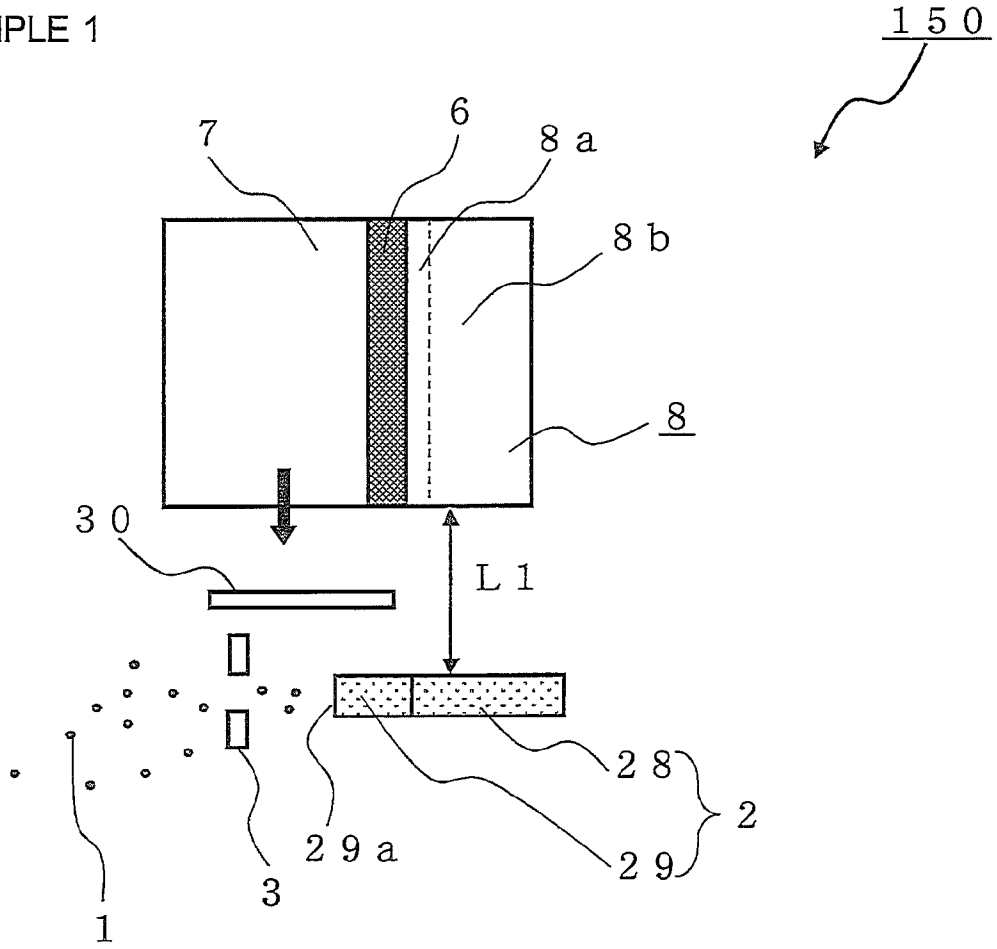
FIG. 6 shows the first embodiment, and is a side view of an electrostatic atomizer 150 of a deformed example 1.

Next, some deformed examples of the first embodiment will be explained. FIG. 6 shows an electrostatic atomizer 150 of a deformed example 1. In the electrostatic atomizer 100 of FIG. 1, the top end atomizing unit 29 of the atomizing electrode 2 is projected on the long-side direction side surface of the trunk unit 28 in the same direction as the projected direction of the cooling fins 8*b*; however, in the electrostatic atomizer 150, the top end atomizing unit 29 of the atomizing electrode 2 is projected on the long-side direction side surface at the opposite side of that surface, so as to be projected in the direction being opposite to the projected direction of the cooling fins 8*b*, namely, the projected direction of the fins of the heat radiating part 7. The counter electrode 3 is provided at the side of the heat radiating part 7 so as to face the top end atomizing unit 29 at that time. By this arrangement, another effect can be added that it is possible to widely spread the electrostatic mist 1 released from the opening of the counter electrode 3 by putting on the airflow passing the heat radiating part 7 which has larger flow amount compared with the cooling unit 8.

However, in case of the deformed example 1, formation of Taylor cone of water or Rayleigh fission is inhibited by a large amount of passing airflow, and proper and stable generation of the electrostatic mist 1 might be inhibited, so that it is better to suppress passing of the airflow in the part where the electrostatic mist 1 is generated by providing an appentice 30 at the top end atomizing unit 29 and the counter electrode 3, and the upstream side (but the downstream side to the heat radiating part 7) of the space between the top end atomizing unit 29 and the counter electrode 3 as shown in FIG. 6.

Figure 7:
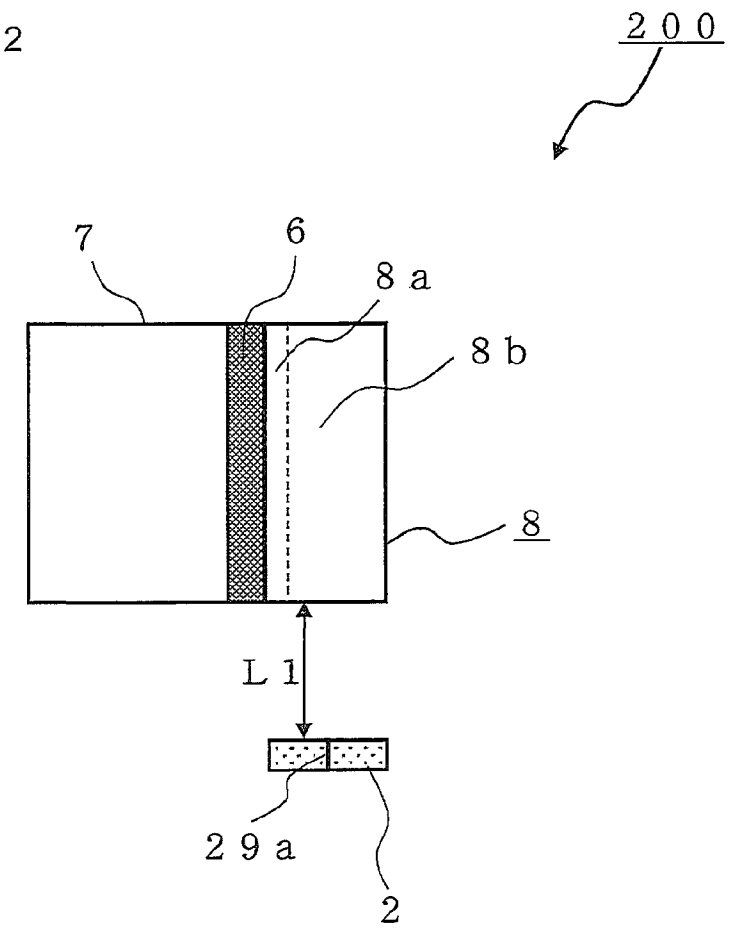
FIG. 7 shows the first embodiment, and is a side view of an electrostatic atomizer 200 of a deformed example 2.
Figure 8:
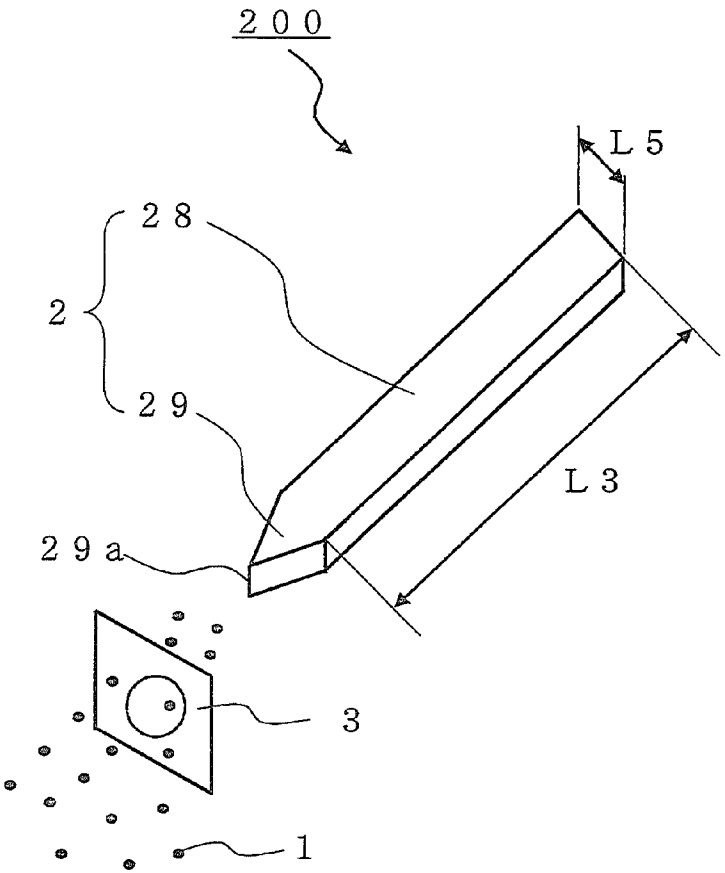
FIG. 8 shows the first embodiment, and is a top plan view of an atomizing electrode 2 used for the electrostatic atomizer 200 of the deformed example 2.

Next, with reference to FIGS. 7 and 8, the electrostatic atomizer 200 of a deformed example 2 will be explained. In the electrostatic atomizer 200 of the deformed example 2, the top end atomizing unit 29 is provided at the end part (on the short-side direction side surface) of the trunk unit 28, that is, the position of the top end atomizing unit 29 with respect to the trunk unit 28 is not like the electrostatic atomizer 100 shown in FIG. 1 in which the projection position of the top end atomizing unit 29 is on the long-side direction side surface of the trunk unit 28.

Also in this case, as well as the electrostatic atomizer 100, the trunk unit 28 is arranged by extending the long-side direction in the direction which agrees with the parallel-aligning direction of the plural cooling fins 8*b* from which the condensation water 10 is dropped. FIG. 8 is a top plan view of the atomizing electrode 2 used for the electrostatic atomizer 200. The dimension L3 and L5 shown in this figure represent the same dimension as L3 and L5 (refer to FIG. 4) of the atomizing electrode 2 of the electrostatic atomizer 100, the positional relation of the cooling fins 8*b* with the dimension L2 and L4 (refer to FIG. 3) is also the same as the electrostatic atomizer 100. By this configuration, the condensation water 1 dropped from the plural cooling fins 8*b* can be received directly by the top surface of the trunk unit 28 laconically and steadily.

Since the projection which is the top end atomizing unit 29 is projected in the parallel-aligning direction of the cooling fins 8*b*, the counter electrode 3 is provided forwardly of the projected top end atomizing unit 29. Also in the electrostatic atomizer 200 of the deformed example 2, the atomizing electrode 2 itself includes three functions, such as the water receiving unit, the water delivering means, and the atomizing unit (the generating part of the electrostatic mist 1). In addition to the effect to collect water efficiently at the top end atomizing unit 29 to carry out the electrostatic atomization efficiently and stably, since the projection does not exist in the middle of the long-side direction, the delivery operation of the atomizing electrode 2 is facilitated, so that it is possible to obtain an effect to increase the reliability of the delivery operation.

Figure 9:
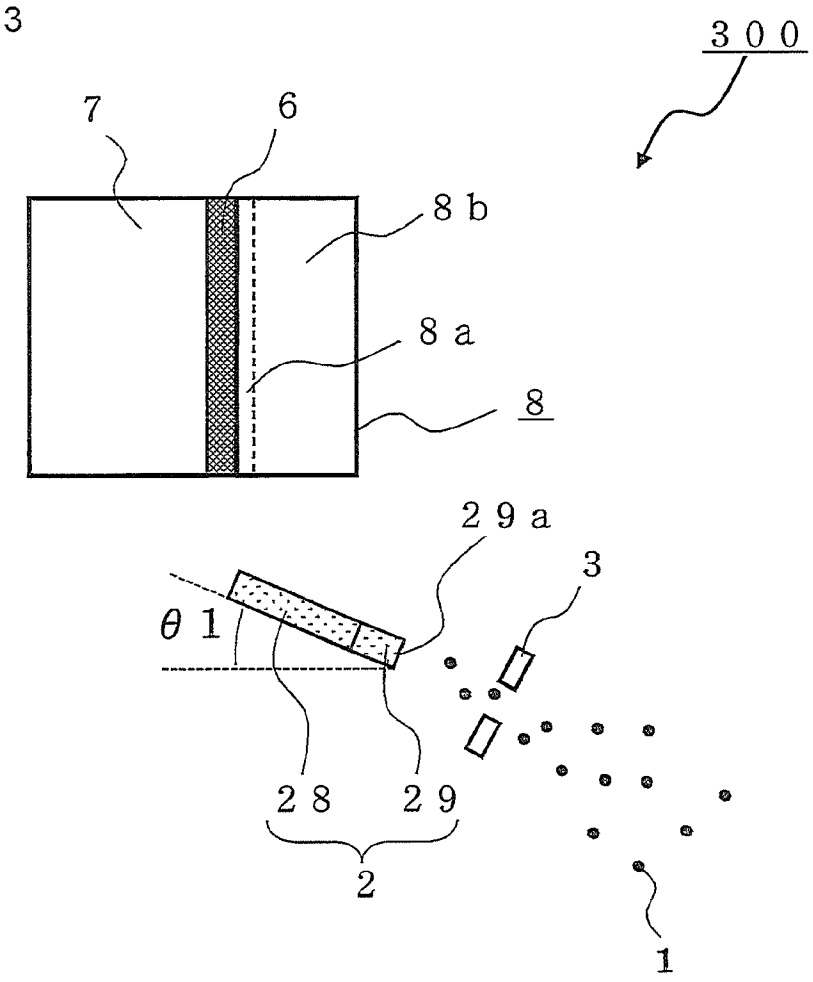
FIG. 9 shows the first embodiment, and is a side view of an electrostatic atomizer 300 of a deformed example 3.

FIG. 9 is a side view of the electrostatic atomizer 300 of a deformed example 3. The difference with the electrostatic atomizer 100 of FIG. 1 is a providing angle of the atomizing electrode 2 (the top end atomizing unit 29 and the trunk unit 28). In the electrostatic atomizer 100, the atomizing electrode 2 is provided horizontally, and of the cooling unit 8, the parallel-aligning direction of the cooling fins 8*b* and the projected height direction are both horizontal, the lower end surface of the cooling fin 8*b* and the top surface of the atomizing electrode 2 are provided also in parallel to both of the parallel-aligning direction of the cooling fins 8*b* and the projected height direction.

However, in the electrostatic atomizer 300 of the deformed example 3 shown in FIG. 9, although the cooling unit 8 is provided horizontally similarly to the electrostatic atomizer 100, the atomizing electrode 2 is provided by slanting with the angle θ1 (refer to FIG. 9) from the trunk unit 28 towards the top end atomizing unit 29 (provided projectedly on the long-side direction side surface of the trunk unit 28) in the direction of gravitational force. The size of the angle θ1 is around 5 to 30 degrees.

In the electrostatic atomizer 300 in which the atomizing electrode 2 is provided like this, the gravitational force can be used for the water delivery from the trunk unit 28 to the top end atomizing unit 29 in addition to the movement by the surface diffusion of water through the inside voids, and thus it is possible to obtain another effect that, for example, even if the condensation water 10 generated in the cooling unit 8 is little, the condensation water 10 received by the trunk unit 28 can be delivered rapidly to the top end atomizing unit 29.

Figure 10:
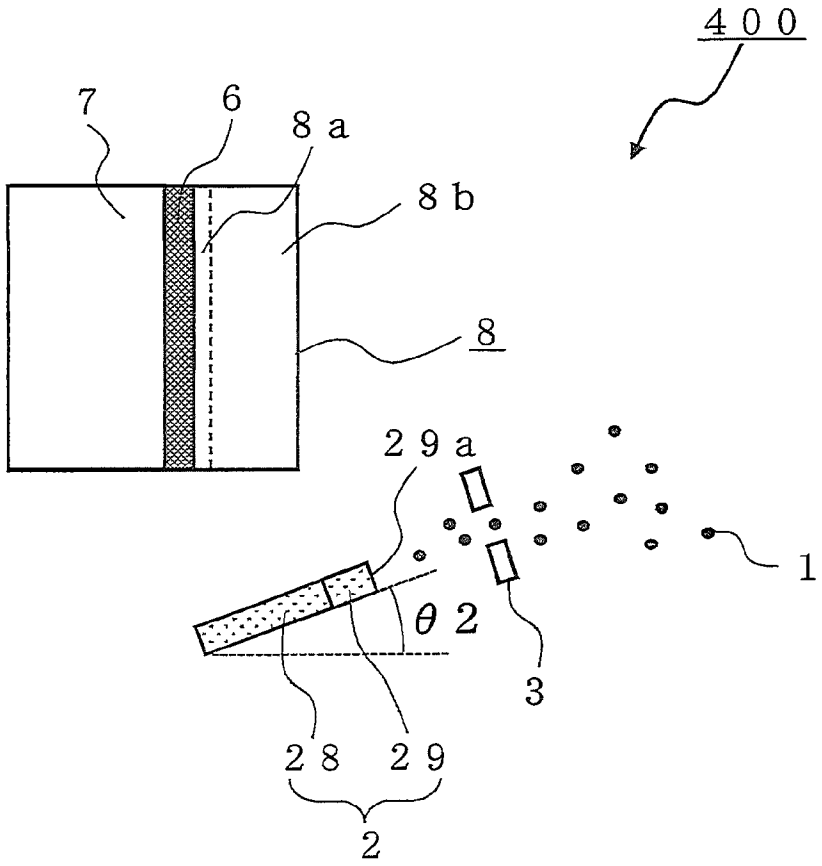
FIG. 10 shows the first embodiment, and is a side view of an electrostatic atomizer 400 of a deformed example 4.

Next, FIG. 10 is a side view of the electrostatic atomizer 400 of a deformed example 4. The electrostatic atomizer 400 is different from the electrostatic atomizer 300 of FIG. 9 in that the slanting direction of the atomizing electrode 2 (the top end atomizing unit 29 and the trunk unit 28) is opposite. In the electrostatic atomizer 400 of the deformed example 4 shown in FIG. 10, although the cooling unit 8 is provided horizontally similarly to the electrostatic atomizer 300, the atomizing electrode 2 is provided by slanting with an angle θ2 (refer to FIG. 10) from the trunk unit 28 towards the top end atomizing unit 29 (provided projectedly on the long-side direction side surface of the trunk unit 28) in the direction of anti-gravitational force. The size of the angle θ2 is around 5 to 30 degrees.

In the electrostatic atomizer 400 in which the atomizing electrode 2 is provided like this, for example, if the humidity in the air supplied to the cooling unit 8 is high, and the condensation water 10 is dropped excessively to the trunk unit 28, it is possible to discharge the excessive water in the direction being opposite to the projected direction of the top end atomizing unit 29. In this electrostatic atomizer 400, since the excessive water does not flow into the top end 29*a* of the top end atomizing unit 29 by discharging the excessive water from the opposite side of the top end atomizing unit 29, the generation of the electrostatic mist 1 is not inhibited by the excessive water, and it is possible to generate the electrostatic mist 1 properly and stably.

Here, if the atomizing electrode 2 is provided by slanting from the trunk unit 28 towards the top end atomizing unit 29 in the direction of anti-gravitational force, since the atomizing electrode 2 is formed by the metal porous body, if the inside is not saturated with water, it is possible to deliver the water to the top end atomizing unit 29 through the inside voids (the pores) by the surface diffusion against the gravitational force.

Figure 11:
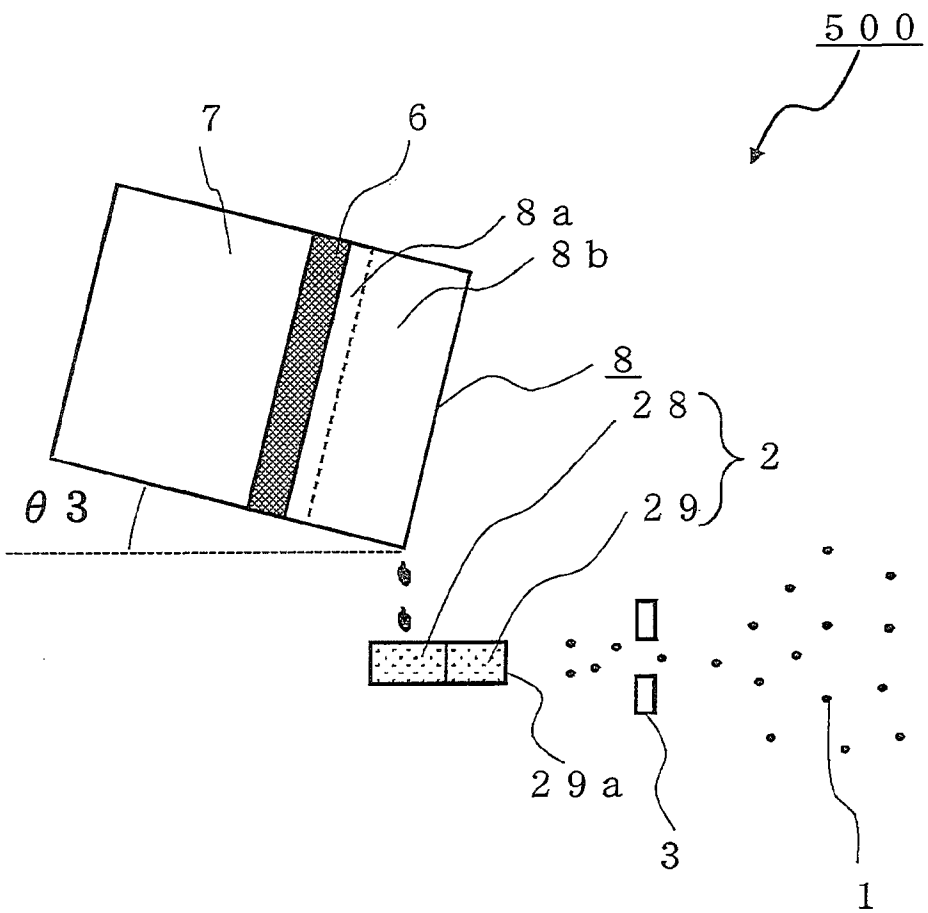
FIG. 11 shows the first embodiment, and is a side view of an electrostatic atomizer 500 of a deformed example 5.

Next, FIG. 11 is a side view of the electrostatic atomizer 500 of a deformed example 5. The difference with the electrostatic atomizer 100 of FIG. 1 is the providing angle of the cooling unit 8. In the electrostatic atomizer 500 of the deformed example 5 shown in FIG. 11, the cooling unit 8 is provided by slanting with the angle θ3 (refer to FIG. 11) from the base board 8*a* (the base end of the cooling fins 8*b*) which is at the Peltier unit 6 side towards the projected end of the cooling fins 8*b* in the direction of gravitational force. The size of the angle θ3 is around 10 to 30 degrees.

In the electrostatic atomizer 500 in which the cooling unit 8 is provided like this, water condensed on the surfaces of the cooling fins 8*b* is transmitted to the lower end with being guided to the projected end side of the cooling fins 8*b* by the gravitational force. Therefore, the dropping location of the water dropped from the lower ends of the cooling fins 8*b* can be limited to a narrow range at the projected end side of the cooling fins 8*b*.

In the electrostatic atomizer 100 of FIG. 1, all of the range of the projected height L4 of the cooling fins 8*b* is the dropping location; however in this electrostatic atomizer 500, it is possible to make the range of the dropping location of the condensation water 10 narrower than L4. Therefore, it is possible to make the short-side direction width of the trunk unit 28 of the atomizing electrode 2 smaller than L4. Namely, the short-side direction width of the trunk unit 28 can be made smaller compared with the electrostatic atomizer 100. In this electrostatic atomizer 500, the width L5 (refer to FIG. 4) of the short-side direction of the top surface of the trunk unit 28 exposed to the cooling fins 8*b* can be made smaller than the electrostatic atomizer 100.

By this structure, the delivering distance to the top end atomizing unit 29 in the short-side direction of the trunk unit 28 is shortened, this electrostatic atomizer 500 can deliver the condensation water 10 received by the trunk unit 28 to the top end atomizing unit 29 more rapidly than the electrostatic atomizer 100 of FIG. 1; thus it is possible to obtain an effect that the time from starting the operation before the generation of the electrostatic mist 1 can be further reduced.

Further, it is possible to reduce the volume of the atomizing electrode 2; thus it is also possible to save resource and reduce the cost. Here, the providing angle of the atomizing electrode 2 of the electrostatic atomizer 500 shown in FIG. 11 is also horizontal similarly to the electrostatic atomizer 100 of FIG. 1; however, the providing angle can be slanted like the deformed example 3 of FIG. 9 or the deformed example 4 of FIG. 10, and if slanted like that, it is also possible to obtain the effect of the deformed example 3 or the deformed example 4.

Here, as discussed previously, if the water amount in the atomizing electrode 2 is large, the coulomb force does not exceed the surface tension of water that forms Taylor cone, water becomes hard to leave from the top end 29*a* of the top end atomizing unit 29, namely, the water is hardly popped out of the top end 29*a*, and the generation of the electrostatic mist 1 is sometimes inhibited. Thus more efficient generation of the electrostatic mist 1 can be carried out if the inside voids (the pores) of the atomizing electrode 2 is not saturated with water. Therefore, by suppressing the power distribution to the Peltier unit 6, it is preferable to control generation amount of the condensation water 10 so as not to make the atomizing electrode 2 be saturated with water.

Up to the above, including plural deformed examples, the configuration of the electrostatic atomizer, in particular, the shape or the arrangement structure of the atomizing electrode 2 has been explained. Hereinafter, the configuration of the atomizing electrode 2 will be explained in detail. In all of the electrostatic atomizers 100 to 500 that have been explained in the present embodiment up to the above, the atomizing electrode 2 is formed by using the foam metal which is the metal porous body as its material.

In conventional electrostatic atomizer, ceramic such as titania, mullite, silica, alumina, etc. has been used as the porous body material which works both as the water delivery function and discharge function (for example, Patent Document 1). Ceramic includes an advantage of the ability of water delivery by capillary action, good workability, superiority in the abrasion resistance against high voltage, etc.

However, although ceramic is the porous body material, the inside of ceramic is relatively dense such that the inside porosity (the inclusion rate of the pores) is around 10 to 50% and the pore diameter (the outer diameter) of the pore is 0.1 to 1.0 μM, at largest 3.0 μm, so that it takes time to deliver water to be atomized to the discharging part of the top end by capillary action. There are disadvantages that it takes long from starting the operation before the mist generation, further, the pores may be clogged due to impurities, water may be bridged, and water absorbing property and water delivering performance cannot be maintained high for a long period of time. Further, since the volume resistance rate (the electric resistance rate) of ceramic is high, the high-voltage applied on ceramic does not work sufficiently on the water to be atomized, the atomization is hard to occur, and there is also a problem that it is impossible to obtain enough amount of mist.

Further, when the metal bar is used as the electrode at the discharging side instead of porous material, it is impossible to deliver water to the top end which is the discharging part since the metal bar does not include pores inside. Therefore, the metal bar itself is sometimes cooled to generate the condensation water directly on the top end surface; however, the water amount of the water condensed on the top end surface of the metal bar is small, and there is a problem that sufficient amount of mist cannot be obtained using only the water condensed on the top end surface of the metal bar.

Then, in the present embodiment, the foam metal which is the metal porous body is proposed to use as material for the atomizing electrode 2, since the foam metal is material which has low electric resistance rate (volume resistance rate) and high conductivity, while having sufficient water absorption property and water delivering performance, and thus efficiently conveys electricity to the water to be atomized.

Here, the foam metal is defined as the metal porous body having three-dimensional net structure. The three-dimensional net structure is known as resin foam represented by sponge, and the foam metal has the same structure as this. Sintered metal is well known as the metal porous body. The different point of the foam metal from the sintered metal, the porosity of the foam metal is high and the pore diameter of the pore is large due to the three-dimensional net structure.

The foam metal is made by adding foaming agent in the liquid mixture containing metal so-called slurry, and under the status where the mixture is foamed, by sintering at an extremely high temperature. By this operation, the foam material can be made using raw materials of various metals or alloys. The foam metal made like this has a continuous pore structure. Although the foam metal has been used mainly for a filter, a catalyst carrier, a fuel cell gas diffusion layer, etc., this time, it is found that the foam metal has superior feature as material of the electrode of the electrostatic atomizer.

The most remarkable characteristic of the foam metal is high porosity. The porosity is also called as the void ratio showing the inclusion rate of pores, which can be evaluated by examining how much water absorption is made inside of the foam metal. This evaluation method follows the principle of Archimedes that a body immersed in a fluid is buoyed up by a force equal to the weight of the displaced fluid.

In the foam metal used for the atomizing electrode 2 of the present embodiment, it is possible to set the porosity extremely high such as 60 to 98% due to the three-dimensional net structure. Therefore, the inside of the foam metal, namely, the atomizing electrode 2 can absorb a large amount of water. However, when the porosity is too large, although the water absorption property can be increased, the absorbed water might leak; thus it is preferable to set the porosity to 60 to 90% for the atomizing electrode 2.

On the other hand, as for the ceramic such as titania or mullite, etc. which has been conventionally used as the porous body, in most cases, the porosity is around 10 to 50%, approximate 35%. Further, in case of general sintered metal which is not the foam metal, the porosity is around 50% if it is high, so that the porosity of the foam metal is clearly high.

Figure 12:
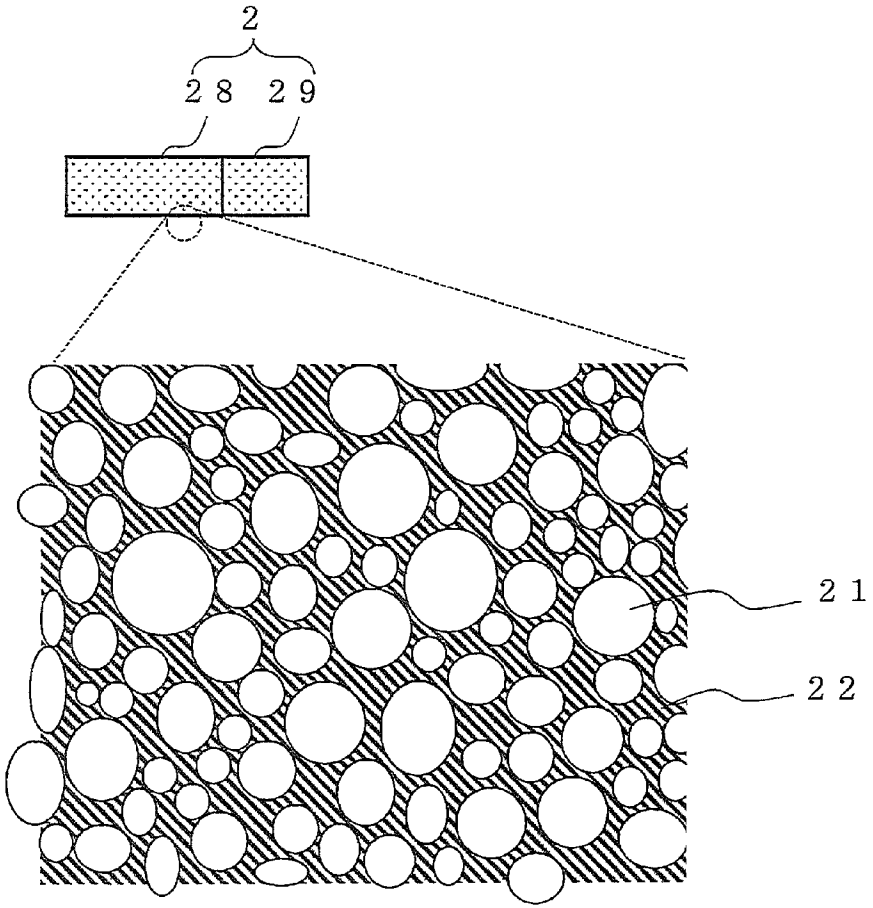
FIG. 12 shows the first embodiment, and is an enlarged conceptual diagram for explaining foam metal used for the atomizing electrode 2.

Further, as another large characteristic of the foam metal, it can be noted that the pore diameter is large. FIG. 12 shows an enlarged conceptual diagram for explaining the foam metal. Since FIG. 12 shows flatly (two dimensionally), each pore seems to be independent; however, actual foam metal is the continuous pore structure in which the pores exist continuously three dimensionally. As shown in FIG. 12, the foam metal used for the atomizing electrode 2 in the electrostatic atomizers 100 to 500 of the present embodiment is structured by a sintered metal part 22 and a pore 21 which is a void part. Here, a diameter of the pore 21 is defined as a pore diameter. The size of the pore diameter can be determined by an image taken by an electronic microscope. Further, it is possible to measure not only the pore diameter but also distribution status of pores using a mercury intrusion porosimetry or a gas adsorption measuring device.

Although the pore diameter of the foam metal of the atomizing electrode 2 is good to be 10 to 1000 μm, the foam metal having the pore diameter of 50 to 600 μm is preferable from the viewpoint of water absorption property or prevention of clogging, and further, the foam metal having the pore diameter of 150 to 300 μm is the most preferable considering the stiffness or the productivity (workability).

When the pore diameter is less than 10 μm like ceramic, there is a high risk of clogging since the pore diameter is too fine (too small), and the water absorption amount of such material is small. Further, it is difficult to make all the size of the pores 21 small stably in production of the foam metal. On the contrary, if the pore diameter exceeds 1000 μm, the water absorbed through the continuous pores 21 might easily leak, which makes hard to deliver water from the trunk unit 28 to the top end atomizing unit 29.

Figure 13:
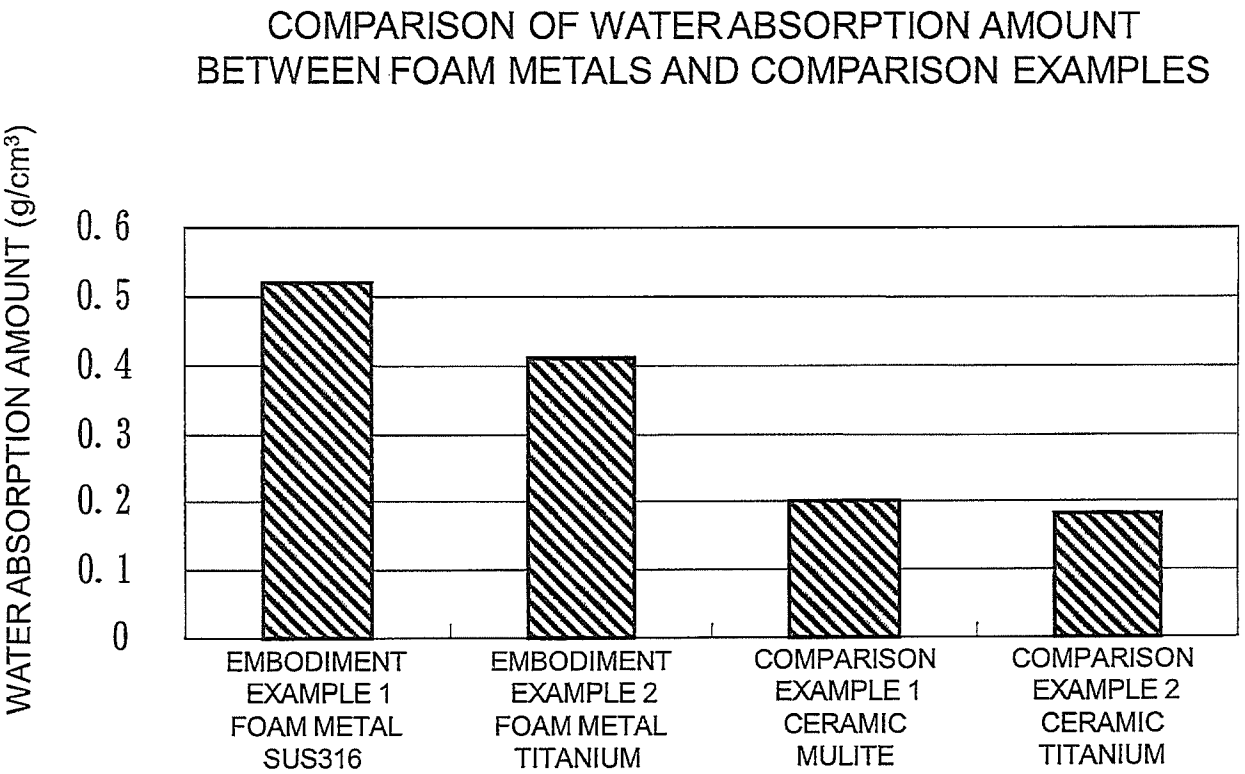
FIG. 13 shows the first embodiment, and is a drawing for comparing water absorption amount of foam metal and Comparison Examples.

Here, the water absorption amount of the foam metal used for the atomizing electrode 2 will be compared with that of the ceramic porous body which has been conventionally used for the electrode at the discharging side. FIG. 13 shows the results. In Embodiment Example 1 which is the foam metal using austenitic stainless steel SUS316 as raw material, the water absorption amount is around 0.5 g/cm$^3$, and in Embodiment Example 2 which is the foam metal using titanium as raw material, the water absorption amount is around 0.4 g/cm$^3$. On the other hand, in cases of the ceramic material, in both cases of mullite which is Comparison Example 1 and titania which is Comparison Example 2, the water absorption amount is around 0.2 g/cm$^3$. It is found that the foam metal has two times water absorption performance as that of ceramic.

The foam metal having the high porosity and a large pore diameter inside has high water absorption performance compared with ceramic as shown in FIG. 13. The high water absorption performance (in other words, water absorption amount is large) means the amount and the speed of inside movement of the water is also large, namely, delivery performance is also high. Therefore, the atomizing electrode 2 formed by the foam metal allows water to move rapidly to the top end atomizing unit 29 compared with the case using the ceramic. Since the water absorption amount is large, it is possible to reduce the time before starting the electrostatic atomization from starting the operation of the electrostatic atomizers 100 to 500. In addition, it is possible to prevent an event that electrostatic atomization may discontinue because the water delivery to the top end atomizing unit 29 from the trunk unit 28 is stopped temporarily, and it is possible to generate the electrostatic mist 1 properly and stably.

Further, the inside of the foam metal, water is moved mainly by the surface diffusion through the three dimensionally continuous pores 21, so that as for the providing direction of the atomizing electrode 2, it is possible to set the top end atomizing unit 29 directed to the ceiling direction or directed horizontally, irrelevant to the direction of gravitational force. Then, since the atomizing electrode 2 is a continuous pore structure and the pore diameter of the pores 21 is large, the water can be delivered stably to the top end atomizing unit 29 for a long period of time without clogging.

Figure 14:
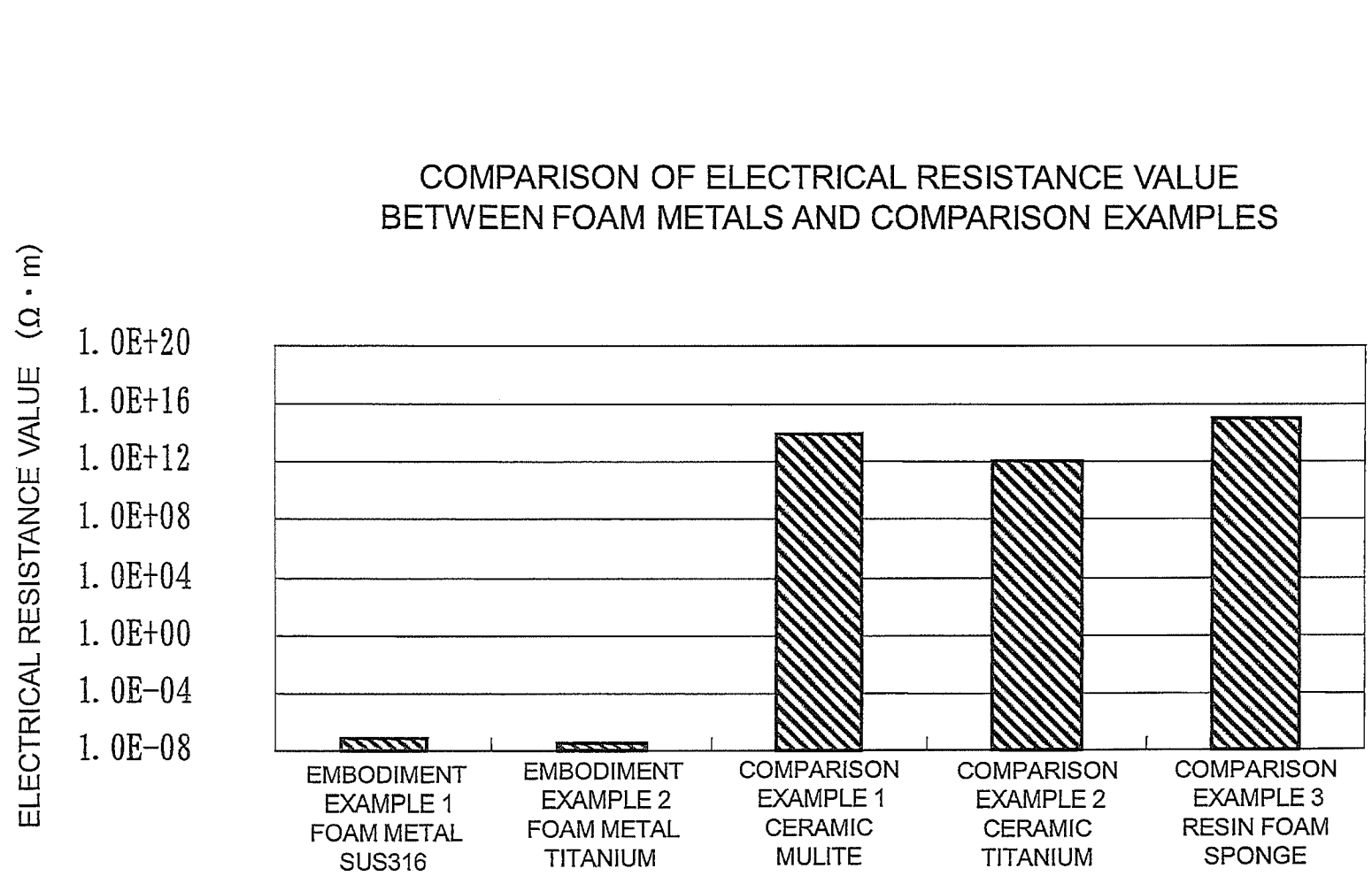
FIG. 14 shows the first embodiment, and is a drawing for comparing electric resistance rate of the foam metal and the Comparison Examples.
Figure 15:
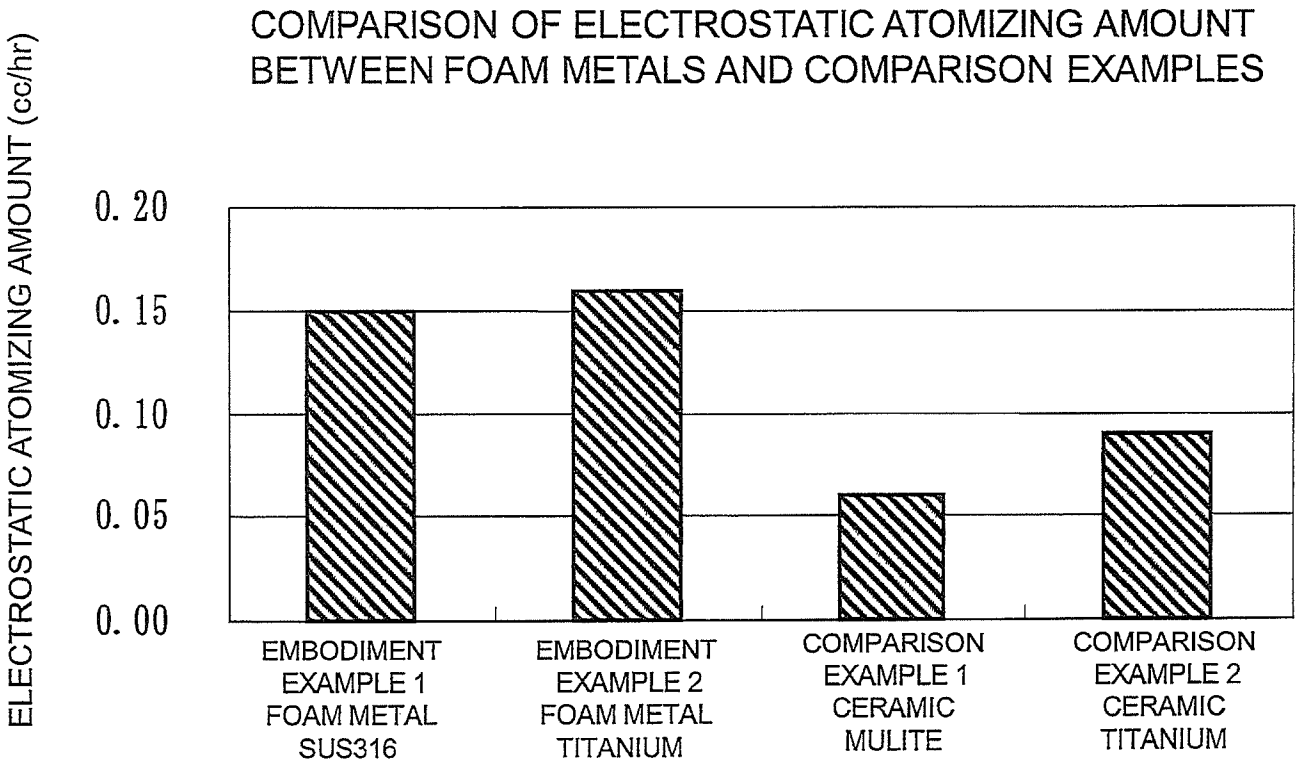
FIG. 15 shows the first embodiment, and is a drawing for comparing electrostatic atomizing amount of the foam metal and the Comparison Examples.

Subsequently, FIG. 14 shows the result of comparing the electric resistance rate of the foam metal and other porous bodies, and FIG. 15 shows the result of comparing the electrostatic atomizing amount of the atomizing electrode 2 of the present embodiment formed by the foam metal and the atomizing electrode formed by ceramic and having the same shape as the atomizing electrode 2. Here, the electrostatic atomizing amount means the mist generation amount showing the weight of the electrostatic mist 1 generated by the electrostatic atomizer using the above the atomizing electrode per a unit time (popped out of the atomizing electrode), and it is possible to estimate the degree of humidity elevation of the inside of a box of predetermined volume. Here, the supply voltage of the high-voltage supply unit 4 is made the same in FIG. 15.

In the electrostatic atomizers 100 to 500, high voltage works on the water of the top end atomizing unit 29 of the atomizing electrode 2, and coulomb force generated by the application of high voltage exceeds the surface tension of water, and thereby the charged water is popped out of the top end 29*a*, crushed continuously (Rayleigh fission), and released in the air from the opening of the counter electrode 3 as the electrostatic mist 1. Therefore, it is important to efficiently apply electricity on the water existing in the atomizing electrode 2. Namely, it is important to convey the high potential supplied from the high-voltage supply unit 4 to the water (the condensation water 10 dropped from the cooling fins 8*b*) existing in the atomizing electrode 2, with reducing the loss as much as possible, and to charge the water; for that purpose, the smaller the electric resistance of the atomizing electrode 2 itself is, the more the loss consumed by that resistance can be reduced, and the electric conductivity is increased to allow to charge the water efficiently. Then, the electric resistance of the atomizing electrode 2 is often specified according to its material.

As for the electric resistance rate of the foam metal, although it is the foam, since the foam metal is absolutely metal and conductor, in both cases of Embodiment Example 1 of SUS316 in which the raw material is stainless steel and Embodiment Example 2 of titanium, electric resistance is extremely small such as around $1\times10^{-7}$ Ω·m, so that the foam metal conducts electricity very well, namely, it is possible to convey the electricity efficiently to the water, with reducing the loss, and to charge the water. On the other hand, as for the electric resistance rate of ceramic material, the electric resistance is large such as $1\times10^{14}$ Ω·m in case of mullite shown in Comparison Example 1 and $1\times10^{12}$ Ω·m in case of titania shown in Comparison Example 2, so that the ceramic material cannot be called as a conductor, but it is an intermediate between a semi-conductor and an insulator. The ceramic material shows the high electric resistance rate similarly to the sponge which is the resin foam of Comparison Example 3.

As discussed above, by forming the atomizing electrode 2 using the foam metal as material, it is possible to charge water more efficiently than the case using the ceramic as material. Namely, if the high-voltage supplied by the high-voltage supply unit 4 is the same size, when using the atomizing electrode 2 using the foam metal as material according to the present embodiment, it is possible to convey the electric current more easily to the water and to charge the water more efficiently than the case using the ceramic as material. By forming the atomizing electrode 2 using the foam metal as material, the electric resistance is reduced, so that the electric power consumed by the electrostatic atomization can be smaller than the case using the ceramic as material; thus it is possible to contribute to saving of energy.

Further, as shown in FIG. 15, when the atomizing electrode has the same shape and the supply voltage of the high-voltage supply unit 4 is made the same, and the electrostatic atomizing amount are compared. The electrostatic atomizing amount of the atomizing electrode 2 formed by the foam metal as material is around 0.15 cc/hr per an electrode of the atomizing electrode 2 in both cases of Embodiment Example 1 using SUS316 as the raw material of the foam metal and Embodiment Example 2 using titanium. On the other hand, as for the ceramic material, the electrostatic atomizing amount is smaller than Embodiment Examples using the foam metal such as 0.06 cc/hr in case of mullite shown in Comparison Example 1, and 0.08 cc/hr in case of titania shown in Comparison Example 2.

Although both of them are ceramic, the electrostatic atomizing amount of titania is larger than mullite; from FIG. 14, it is found that the electric resistance rate of mullite is 2 digits lower than titania. In FIG. 14 and FIG. 15, it is found by comparing cases using ceramic, namely, Comparison Example 1 and Comparison Example 2, that when the atomizing electrode can easily conduct electricity (the electric resistance rate is small), electricity is applied and charged efficiently to the water, Taylor cone of water formed at the top end 29*a* of the top end atomizing unit 29 is popped out easily by the coulomb force, and thus the electrostatic atomizing amount is increased. From these results, when the foam metal which is a conductor and of which the electric resistance rate is low is used for the atomizing electrode 2 of the electrostatic atomizers 100 to 500, high voltage can be applied (can be charged) efficiently on water to be atomized, and if the supply voltage from the high-voltage supply unit 4 is the same size, electrostatic atomizing amount (the production amount of the electrostatic mist 1) can be increased compared with conventional case using the ceramic material.

Here, the atomizing electrode 2 formed by the foam metal is made by producing a large sheet-shaped foam metal having the thickness of around 0.5 mm to 5.0 mm and cutting the sheet-shaped foam metal to form a desired shape (the trunk unit 28 and the top end atomizing unit 29 which are continuous). Mass production is possible by laminating the sheet-shaped foam metal in the plate thickness direction and cutting out multiple pieces simultaneously. The cutting out is carried out by wire-cut or laser-cut. It is possible to process to form into the desired shape using other various kinds of processing methods such as punching by Thompson blade or press, cutting by machine, cutting by hand, bending work, etc. Although it is not used for the atomizing electrode 2, the foam metal can be jointed by welding or waxing.

Figure 16:
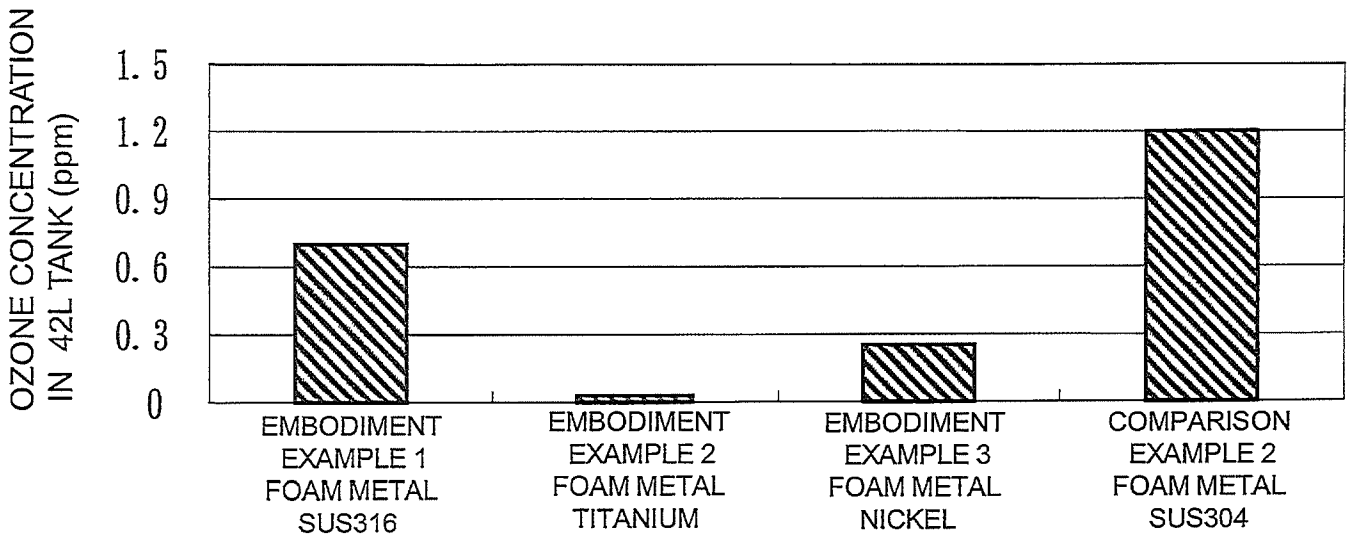
FIG. 16 shows the first embodiment, and is a drawing for comparing ozone production according to different raw materials of the foam metal.

Next, FIG. 16 shows the comparison result of the ozone production according to different raw materials (quality of materials) of the foam metal. When discharge occurs from the atomizing electrode 2 to the counter electrode 3, ozone is generated accompanied with the discharge. Although ozone is useful in its antiseptic property if the amount is appropriate, when the generation amount is excessive, the smell is felt unusual for the human from its grass-like smelling, or it sometimes works oxidation action or corrosion action on the human or the surrounding substances. Therefore, in the electrostatic atomizers 100 to 500 for releasing the electrostatic mist 1, it is desired to suppress the production amount of ozone generated by the discharge as much as possible.

Then, the production amount of ozone in the atomizing electrode 2 formed by the foam metal is examined by experiment. The contents of experiment are to examine a steady-state value of ozone concentration inside of 42 L (liter) box (42 L tank) when the predetermined same size of high voltage is applied on the atomizing electrode 2.

In FIG. 16, the foam metal shown in Comparison Example 4 is SUS304 (nickel content of 8 to 10.5%, chrome content of 18 to 20%) which is generally well-known as austenitic stainless steel, and as the ozone production in this case, the ozone concentration inside of 42 L tank is 1.2 ppm. On the other hand, although it is the same austenitic stainless steel, in case of Embodiment Example 1 using SUS316 with nickel content of 11 to 15%, chrome content of 16 to 20%, and molybdenum content of 1 to 4%, the ozone concentration of 42 L tank is 0.7 ppm, which corresponds to around 60% compared with Comparison Example 1 using SUS304.

Although they are the same austenitic stainless steel, it is found that the ozone production is less when content of nickel is large, and further, some % of molybdenum is contained. Therefore, when the atomizing electrode 2 is formed by the foam metal using the stainless steel as raw material, it is preferable to use austenitic stainless steel in which content of nickel is equal to or greater than 11% and content of molybdenum is 1 to 4%. Other than SUS316 used in Embodiment Example 1, since SUS316L and SUS317 contains equal to or greater than 11% of nickel and molybdenum, the ozone production can be reduced compared with the case using SUS304.

It is found that the ozone production of Embodiment Example 2 shown in FIG. 16 formed by the foam metal using titanium as raw material is the least such that the ozone concentration of the 42 L tank is 0.03 ppm, that is, 1/40 of Comparison Example 4 (SUS304) and 1/23 of Embodiment Example 1 (SUS316); the ozone production can be largely suppressed. Further, when Embodiment Example 3 formed by the foam metal using nickel as raw material is used, the ozone concentration inside of the 42 L tank is 0.3 ppm, so that suppressant effect of ozone generation cannot be obtained as much as Embodiment Example 2 (titanium); however, suppressant effect of ozone generation is larger than Embodiment Example 1 (SUS316).

It can be considered such suppressant effect of ozone generation is obtained, because the raw material of the foam metal works reduction action and the generated ozone is resolved. Namely, as for the material of the atomizing electrode 2, the ozone production can be suppressed by using the metal which has reduction action as raw material. Then, among Embodiment Examples shown in FIG. 16, it is considered that titanium works the reduction action of ozone the most. Not as much as titanium, it can be said nickel also works the reduction action from the result of Embodiment Example 3. Therefore, it is considered that among the austenitic stainless steel, SUS316 in which content of nickel is large can suppress the ozone production, and that molybdenum also works the reduction action of ozone. Further, by using the foam metal as material of the atomizing electrode 2, the water can be charged efficiently, so that the generation of ozone itself is less.

Further, when discharge occurs from the atomizing electrode 2 to the counter electrode 3, radical (activated species) is sometimes generated accompanied to the discharge such as hydroxyl radical or superoxide. The chemical reactivity of such radical is extremely high, and the radical is a very unstable substance because it is active. Since it immediately reacts with molecules in the air such as oxygen and nitrogen, etc., it is extremely short-lived in the air, so that it disappears almost instantly even if it is generated. Even if the radical is generated, they would not be released with the electrostatic mist 1, and the electrostatic mist 1 would not include radical.

From the above result, it can be said that the most suitable material of the atomizing electrode 2 is the foam metal using titanium as raw material. Further, as for the foam metal using SUS316, titanium, or nickel as raw material, it is possible to prevent electric corrosion or electric abrasion caused by applying high voltage, and it is possible to maintain the shape of the atomizing electrode 2, in particular, the sharpened shape of the top end atomizing unit 29 for a long period of time. Therefore, it is also possible to obtain the effect that the electrostatic atomization can be stably done for a long period of time. This effect is remarkable from the feature of, in particular, material using titanium as raw material.

Up to the above, it has been explained that since the foam metal has the three-dimensional net structure in which the porosity is high and the pore diameter is large, the foam metal has high water absorption property and high delivering property (the property that the moving speed of water is high). Further, by using such property, it has been explained that the foam metal is suitable as material of the atomizing electrode 2 of the atomizing electrode 2 shown in the present embodiment. Here, further, it is found that by conducting oxidation treatment on the foam metal, hydrophilic property of the surface of the inside pores 21 increases, the water absorption property and the delivering property of the atomizing electrode 2 are improved. The oxidation treatment can be done by exposing the foam metal in the oxygen atmosphere.

The increase of hydrophilic property by the oxidation treatment is remarkable when titanium is used as raw material. When the oxidation treatment is done on titanium, the surface layer has property being close to titanium oxide. Since water acid radical (OH group) is made on the outermost surface by reacting with the surrounding water when titanium oxide receives energy such as ultraviolet, etc., the titanium oxide has high affinity for water (is high hydrophilic). Therefore, when the water is moved by the surface diffusion, the water broadens and proceeds without stopping, and the water inside of the foam metal can be moved efficiently and rapidly. As for the foam metal using titanium as raw material, the result is obtained that the moving speed of the water of the case where the oxidation treatment is done is about five times as much as that of the case where the oxidation treatment is not done.

Even if the foam metal formed by metal material other than titanium such as nickel, etc. as raw material is used, since a layer having high affinity is generated on the surface by the oxidation treatment, the affinity for water (hydrophilic property) is improved. However, the improvement effect of hydrophilic property is remarkable when the oxidation treatment is done on the foam metal using titanium as raw material; the moving speed of water becomes high, and the improvement effect of the water absorption property and the delivering property of the atomizing electrode 2 is high. In the oxidation treatment for exposing in the oxygen atmosphere, the oxidation treatment is done not only on the outer surface of the atomizing electrode 2 formed by the foam metal, but also on the surface facing the inside pores 21 by passing through the continuous pores because of the continuous pore structure having a high porosity and a large pore diameter. Consequently, hydrophilic property increases in all the surfaces of the metal part 22 including the inside surface facing the pores 21, so that the moving speed of water can be increased. Therefore, it is possible to reduce the time from starting the operation of the electrostatic atomizers 100 to 50 until the release of the electrostatic mist 1.

As has been discussed, one of the characteristics of the atomizing electrode 2 of the electrostatic atomizer related to the present embodiment is that the atomizing electrode 2 is formed by the foam metal having the three-dimensional net structure as material. Therefore, since the water absorption amount is large, and the moving speed of water is high, it takes short from starting the operation of the electrostatic atomizer until starting atomization (the electrostatic mist 1 is released). Then, since the foam metal has the low electric resistance rate and is excellent in electric conductivity, it is possible to have an effect that the electricity can be efficiently applied to the water to be atomized and the water can be charged, and the atomizing amount is increased.

Further, electric corrosion and electric abrasion can be prevented, and the shape of the atomizing electrode 2, in particular, the sharpened shape of the top end atomizing unit 29 can be maintained for a long period of time. Therefore, it is possible to have an effect that the electrostatic atomization can be stably implemented for a long period of time.

Further, a large amount of water can be absorbed by the high porosity, and as well since the pore diameter is large, clogging does not occur for a long period of time, and stable and high water absorption property and high delivering property can be maintained for a long period of time; and thus it is possible to have an effect that the electrostatic atomization can be stably implemented for a long period of time.

Further, by using either of titanium, nickel, or austenitic stainless steel containing equal to or greater than 11% of nickel and some % of molybdenum, which are metal having the reduction action, as the raw material of the foam metal, it is possible to have an effect that the production amount of ozone generated by the discharge can be suppressed. This effect is remarkable, in particular, when the atomizing electrode 2 is formed by the foam metal using titanium as raw material.

Further, if the atomizing electrode 2 is formed by the foam metal on the surface of which the oxidation treatment is done after sinitering as material, the hydrophilic property of the inside surface is increased, and it is possible to have an effect that the moving speed of water is further improved.

Here, as for the foam metal having the three-dimensional net structure which has been explained up to the above, because of its high water absorption property and high delivering property, it is applicable to not only the atomizing electrode 2 of the electrostatic atomizers 100 to 500 shown in the present embodiment, but also to the electrostatic atomizer of another embodiment; if the foam metal is used for an electrode which also works for water deliverer to the discharging part, it is possible to obtain the same effect as the atomizing electrode 2 of the present embodiment. In the electrostatic atomizer of Patent Document 1, for example, water of the water reserving unit which is the water supply means is delivered to the upper end of an erect delivering body made by ceramic porous body by capillary action, and Taylor cone of water is formed on the upper end which is sharpened in a pin-shape to generate mist. If the delivering body (corresponding to the atomizing electrode 2) is formed by, instead of ceramic, the foam metal which has been explained up to the above, the delivering speed of water is remarkably increased, so that it is possible to reduce the time from starting the operation before electrostatic atomization compared with the case using the delivering body formed by ceramic. Further, electric corrosion or electric abrasion of the upper end sharpened in a pin-shape which is the discharging part can be prevented, and the sharpened shape can be maintained for a long period of time, so that it is possible to implement the electrostatic atomization stably for a long period of time compared with the case using the delivering body formed by ceramic.

Figure 17:
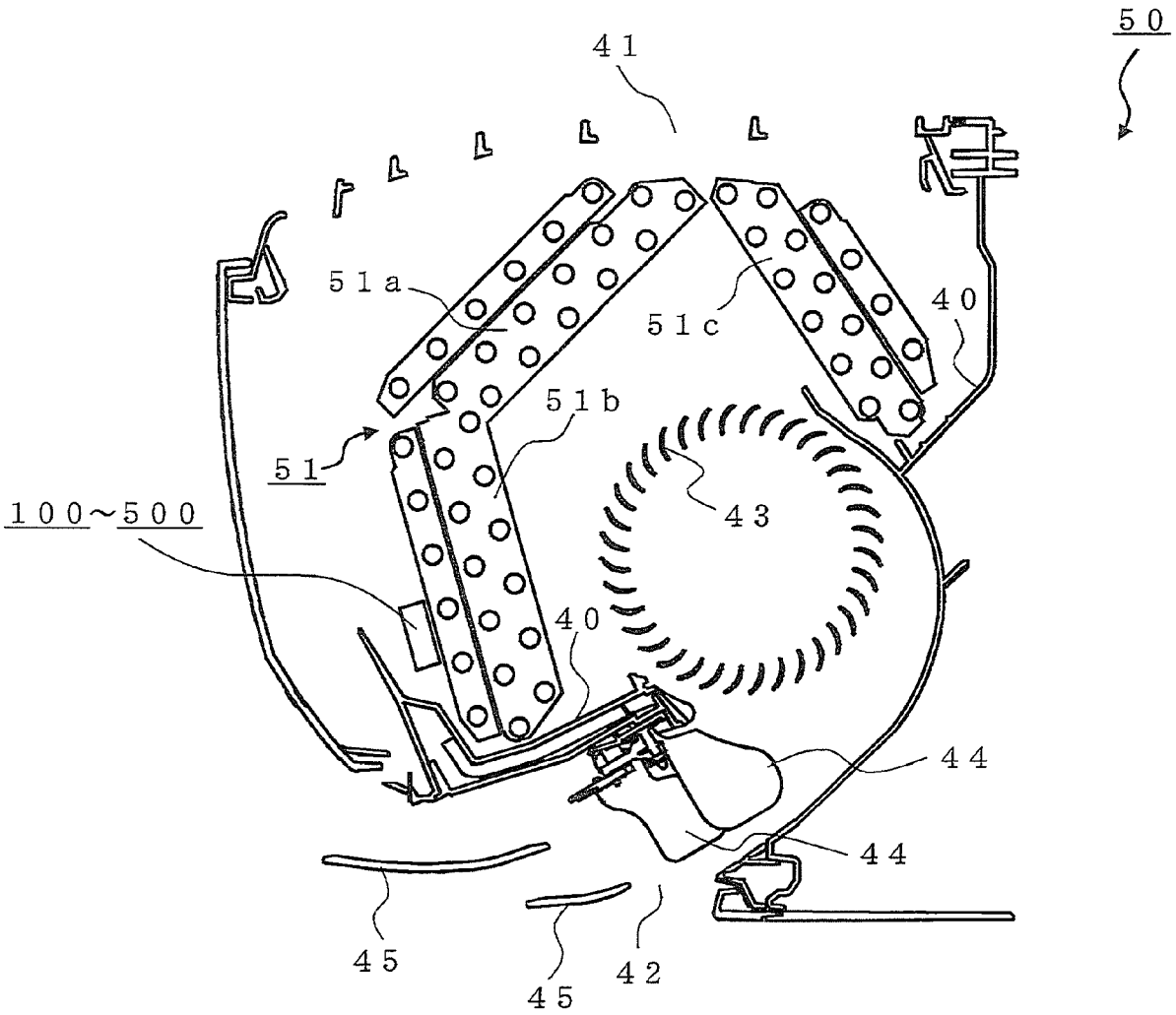
FIG. 17 shows the first embodiment, and is a vertical cross sectional view of an air conditioner 50 including either of the electrostatic atomizers 100 to 500.

Hereinafter, another case will be explained, in which either of the electrostatic atomizers 100 to 500 of the present embodiment is mounted inside of an air conditioner 50. FIG. 17 is a cross sectional view of the air conditioner 50 including either of the electrostatic atomizers 100 to 500. The air conditioner 50 is a general wall-hanging type.

The air conditioner 50 is provided with a suction opening 41 for sucking the indoor air, a supply opening 42 for blowing out conditioned air to the indoors, a heat exchanger 51 (including an upper front heat exchanger 51*a*, a lower front heat exchanger 51*b*, and a back heat exchanger 51*c*) which is an inverted V shape and for generating conditioned air from the indoor air, a drain pan 40 (two pans) for receiving the water condensed by the heat exchanger 51, and a blower fan 43. The indoor air flown from the suction opening 41 located above the main body of the air conditioner 50 by the rotation of the blower fan 43 is heat exchanged with the refrigerant of the refrigerating cycle on passing the heat exchanger 51 to adjust the temperature and the humidity. The heat-exchanged indoor air passes through the blower fan 43, and is blown out to the indoors as the conditioned air from the supply opening 42 positioned below.

The supply opening 42 is provided with a horizontal wind direction board 44 which can change the wind direction of the conditioned air to be blown out and a vertical wind direction board 45, and the blowing direction of the blowing airflow is adjusted. The horizontal wind direction board 44 which can change the horizontal air direction of the blowing airflow is positioned at the upstream side of the vertical wind direction board 45 which can change the vertical air direction of the blowing airflow. Further, the condensation water of the heat exchanger 51 collected by the drain pan 40 is discharged to the outdoor through a drain hose, not illustrated.

Here, in the air conditioner 50, either of the electrostatic atomizers 100 to 500 is provided at either of the windward side (the upstream side) of the lower front heat exchanger 51*b*, or the windward side (the upstream side) of the back heat exchanger 51*c* and also above the drain pan 40. By providing either of the electrostatic atomizers 100 to 500 above the drain pan 40, if a large amount of the condensation water 10 of the cooling unit 8 causes excessive water, the drain pan 40 receives such excessive water and discharges to the outdoors together with the condensation water of the heat exchanger 51. Therefore, there is no probability of leakage of the excessive water of either of the provided electrostatic atomizers 100 to 500 to the indoors.

By providing the air conditioner 50 with either of the electrostatic atomizers 100 to 500, a large amount of the electrostatic mist 1 released from the electrostatic atomizer is made pass through the heat exchanger 51 together with the indoor air sucked from the suction opening 41 and can be released to the indoors together with the conditioned air from the supply opening 42.

Large amount of the electrostatic mist 1 of nanometer size generated in either of the electrostatic atomizers 100 to 500 is released to the indoors together with the conditioned air from the supply opening 42 of the air conditioner 50, since the electrostatic mist 1 is charged negatively, the electrostatic mist 1 tends to approach the human body having a potential difference. Then, since the size of the electrostatic mist 1 is smaller than the corneocyte of the human cell, the electrostatic mist 1 is permeated in exposed skin such as a face or a neck, etc., and gives moisturizing effect to the user. By this operation, the following effect can be obtained.

(1) at the time of heating operation, moisturizing action of the user skin is improved (the moisture of skin is increased).

(2) as the moisture of skin is increased, the sensory temperature of the user is increased.

(3) with that amount, the preset indoor temperature can be decreased in case of heating, and with that amount, the power consumption amount of the air conditioner 50 is decreased, which serves (contributes for) energy-saving.

At the time of heating operation, the increase of the moisture of the exposed part of skin such as a face or a neck of the user, etc. with 25% corresponds to the increase of the indoor humidity with around 20% RH. Then, the increase of around 20% RH of the indoor humidity corresponds to the increase of around 1 degree of the sensory temperature of human. At the time of heating operation, if the preset temperature is decreased with 1 degree, the power consumption amount of the air conditioner 50 can be reduced with around 10%.

Here, when providing either of the electrostatic atomizers 100 to 500 at the windward side of the heat exchanger 51, in either case, it is preferable to arrange so that the parallel-aligning direction of the cooling fins 8*b* or the fins of the heat radiating part 7 should be in the horizontal direction of the main body of the air conditioner 50. By this operation, the sucked airflow from the suction opening 41 is made to flow along the fins, and the heat radiation of the heat radiating part 7 is promoted. Then, when the heat radiating part 7 is arranged so as to face the heat exchanger 51, the flowing amount of airflow (the indoor sucked air) passing the heat radiating part 7 is increased, and the heat radiation is further promoted.

Further, when the heat radiating part 7 is arranged facing the heat exchanger 51, if the electrostatic atomizer is either of the electrostatic atomizer 100, the electrostatic atomizer 300 (deformed example 3), the electrostatic atomizer 400 (deformed example 4), the electrostatic atomizer 500, as well as the electrostatic atomizer 150 (deformed example 1) shown in FIG. 6, the top end atomizing unit 29 is provided on the long-side direction side surface of the trunk unit 28 at the side of the heat radiating part 7 so as to be projected in the direction being opposite to the projected direction of the cooling fins 8*b*. The electrostatic mist 1 is mounted on the airflow having a large flowing amount passing the heat radiating part 7 and can be guided rapidly and steadily to the supply opening 42, and accordingly it is possible to release plenty of the electrostatic mist 1 from the supply opening 42 in a short time from starting the operation of the air conditioner 50. Here, in this case, it is better to suppress the passage of airflow to the part where the electrostatic mist 1 is generated by providing the appentice 30 above the part where the electrostatic mist 1 is generated as shown in FIG. 6.

Then, the atomizing electrode 2 is formed by the foam metal using reducing metal, in particular, titanium as raw material, thereby suppressing the production amount of ozone generated by discharge. Therefore, it is possible to prevent the case where ozone is blown out together with the conditioned air from the supply opening 42 and the user feels unusual smell or the ozone works oxidation action on the human body who requests the moisturizing action. Further, as discussed above, even if the radical (activated species) is generated accompanied to the discharge, since the radical is short-lived and will disappear, the radical is not blown out from the supply opening 42, and the radical is not included in the electrostatic mist 1 to be blown out. Therefore, the radical does not work oxidation action on the human body of the user who requests the moisturizing effect. Although it is charged, pure water of nanometer size permeates the skin of user, so that the moisturizing effect can be increased, without giving harmful effect on the skin.

Here, in the electrostatic atomizers 100 to 500, the foam metal having the three-dimensional net structure is used as material of the atomizing electrode 2. If, for example, another porous body such as ceramic, nonfoam general sintered metal, or resin foam, etc. which delivers water by the capillary action is used for forming the atomizing electrode 2, various effects obtained by using the foam metal cannot be obtained. However, it is still possible to obtain the above-discussed effect brought by the shape and the structure of the atomizing electrode 2 (the trunk unit 28 and the top end atomizing unit 29), the positional relation between the cooling unit 8 (the water supply means) and the atomizing electrode 2, and the providing angle of the atomizing electrode 2 and the providing angle of the cooling unit 8; that is, it is possible to guide the water generated by the cooling unit 8 to the top end atomizing unit 29 laconically and rapidly and to generate a large amount of the electrostatic mist 1 stably.

The electrostatic atomizer related to the present invention can guide rapidly and steadily water dropped from the water supply means to the top end atomizing unit of the water applying electrode, and it is possible to have an effect to generate stably a large amount of the electrostatic mist in a short time from starting the operation.

Having thus described several particular embodiments of the present invention, various alterations, modifications, and improvements will readily occur to those skilled in the art. Such alterations, modifications, and improvements are intended to be part of this disclosure, and are intended to be within the spirit and scope of the present invention. Accordingly, the foregoing description is by way of example only, and is not intended to be limiting. The present invention is limited only as defined in the following claims and the equivalents thereto.

The invention claimed is:

1. An electrostatic atomizer comprising:

water supply means having a Peltier unit and a cooling unit contacting a cooling surface of the Peltier unit, for dropping water condensed at the cooling unit from the cooling unit in a direction of gravitational force; and an atomizing electrode formed by a porous body, the atomizing electrode including a tabular trunk unit and a tabular top end atomizing unit formed integrally with the tabular trunk unit, for receiving the water dropped from the water supply means at the trunk unit, delivering the water from the trunk unit to the top end atomizing unit, and atomizing the water at the top end atomizing unit when high voltage is applied, wherein the top end atomizing unit projects from a side surface of the trunk unit to form a top end part of the top end atomizing unit, the top end part being formed by a single continuous surface with a linearly decreasing width that terminates at a sharpened point with substantially the same thickness as the tabular trunk unit, the top end atomizing unit and the top end part of the top end atomizing unit forming a single continuous and substantially triangular shape in upper plan view, wherein the trunk unit is provided below the cooling unit with a space of a predetermined distance so as not to contact the cooling unit, the trunk unit having a substantially rectangularly shaped uppermost surface, said uppermost surface receiving water from the water supply means, a longitudinal width of the uppermost surface of the trunk unit facing the cooling unit being equal to or greater than a width of the cooling unit in a same direction as a longest side of said uppermost surface, wherein the rectangularly shaped uppermost surface comprises four sides, a first pair of opposing sides having a length longer than a second pair of opposing sides, and wherein the top end atomizing unit projects from one of said first pair of opposing sides of the trunk unit in a direction orthogonal to the one of said first pair of opposing sides of the trunk unit.

2. The electrostatic atomizer of claim 1, wherein a plurality of cooling fins are included in the cooling unit and aligned in a same direction as the longest side of said uppermost surface, and the water supply means drops the water from lower ends of the plurality of cooling fins with the space of the predetermined distance so that the longest side of said uppermost surface corresponds to an alignment direction of the plurality of cooling fins, and the longitudinal width of the uppermost surface of the trunk unit facing the plurality of cooling fins is equal to or greater than a width of the plurality of cooling fins in the alignment direction.

3. The electrostatic atomizer of claim 2, wherein the cooling unit is provided by slanting with a predetermined angle from a base end of the plurality of cooling fins which is at a side of the Peltier unit towards a projected end of the plurality of cooling fins in the direction of gravitational force.

4. The electrostatic atomizer of claim 1, wherein the atomizing electrode is provided by slanting with a predetermined angle from the trunk unit towards the top end atomizing unit in the direction of gravitational force.

5. The electrostatic atomizer of claim 1, wherein the atomizing electrode is provided by slanting with a predetermined angle from the trunk unit towards the top end atomizing unit in a direction of anti-gravitational force.

6. The electrostatic atomizer of claim 1, wherein an angle of a peak of the substantially triangular shape which is most distant from the trunk unit is an acute angle.

7. An air conditioner having a suction opening for sucking indoor air, a supply opening for blowing out conditioned air to indoor, a heat exchanger for generating the conditioned air, and a drain pan for receiving water condensed at the heat exchanger, wherein the electrostatic atomizer of claim 1 is provided at a windward side of the heat exchanger and above the drain pan.

* * * * *